US009879674B2

(12) United States Patent
Akei et al.

(10) Patent No.: US 9,879,674 B2
(45) **Date of Patent: *Jan. 30, 2018**

(54) COMPRESSOR HAVING CAPACITY MODULATION ASSEMBLY

(71) Applicant: Emerson Climate Technologies, Inc., Sidney, OH (US)

(72) Inventors: Masao Akei, Cicero, NY (US); Roy J. Doepker, Lima, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 90 days.

This patent is subject to a terminal disclaimer.

(21) Appl. No.: 14/946,824

(22) Filed: Nov. 20, 2015

(65) Prior Publication Data

US 2016/0076543 A1 Mar. 17, 2016

Related U.S. Application Data

(63) Continuation of application No. 14/081,390, filed on Nov. 15, 2013, now Pat. No. 9,303,642, which is a (Continued)

(51) Int. Cl.
*F03C 4/00* (2006.01)
*F04C 2/00* (2006.01)
(Continued)

(52) U.S. Cl.
CPC ..... *F04C 18/0215* (2013.01); *F01C 1/0215* (2013.01); *F01C 1/0253* (2013.01);
(Continued)

(58) Field of Classification Search
CPC ..... F04C 18/0215; F04C 18/0253; F04C 23/008; F04C 14/26; F04C 28/18;
(Continued)

(56) References Cited

U.S. PATENT DOCUMENTS 4,058,988 A 11/1977 Shaw
4,216,661 A 8/1980 Tojo et al.
(Continued)

FOREIGN PATENT DOCUMENTS

CN 1158944 A 9/1997
CN 1158945 A 9/1997
(Continued)

OTHER PUBLICATIONS

Advisory Action regarding U.S. Appl. No. 14/073,293, dated Apr. 18, 2016.
(Continued)

*Primary Examiner* — Theresa Trieu
(74) *Attorney, Agent, or Firm* — Harness, Dickey & Pierce, P.L.C.

(57) ABSTRACT

A compressor may include a shell, first and second scrolls, a seal assembly, a modulation control chamber, and a modulation control valve. The first scroll may include a first end plate having a biasing passage extending therethrough. The seal assembly may isolate a discharge pressure region from a suction pressure region. The seal assembly and the first scroll may define an axial biasing chamber therebetween that communicates with the axial biasing chamber and a first pocket between the first and second scrolls. The modulation control chamber may be fluidly coupled with the biasing chamber by a first passage. The modulation control valve may be fluidly coupled with the modulation control chamber by a second passage and movable between a first position allowing communication between the second passage and the suction pressure region and a second position restricting communication between the second passage and the suction pressure region.

21 Claims, 17 Drawing Sheets

Related U.S. Application Data continuation of application No. 13/181,065, filed on Jul. 12, 2011, now Pat. No. 8,585,382, which is a continuation of application No. 12/754,920, filed on Apr. 6, 2010, now Pat. No. 7,988,433.

(60) Provisional application No. 61/167,309, filed on Apr. 7, 2009.

(51) Int. Cl.

| | |
|---|---|
| ***F04C 18/00*** | (2006.01) |
| ***F04C 18/02*** | (2006.01) |
| ***F01C 1/02*** | (2006.01) |
| ***F04C 23/00*** | (2006.01) |
| ***F04C 27/00*** | (2006.01) |
| ***F04C 28/26*** | (2006.01) |
| ***F04C 29/00*** | (2006.01) |
| ***F04C 28/18*** | (2006.01) |
| ***F04C 29/12*** | (2006.01) |
| *F01C 21/00* | (2006.01) |

(52) U.S. Cl.

CPC ..... *F04C 18/0253* (2013.01); *F04C 18/0261* (2013.01); *F04C 23/008* (2013.01); *F04C 27/005* (2013.01); *F04C 28/18* (2013.01); *F04C 28/265* (2013.01); *F04C 29/0021* (2013.01); *F04C 29/12* (2013.01); *F01C 2021/165* (2013.01); *F01C 2021/1643* (2013.01); *F04C 2270/58* (2013.01)

(58) Field of Classification Search

CPC .... F04C 28/26; F04C 28/265; F04C 29/0021; F04C 27/005; F04C 2270/58; F01C 1/0215; F01C 1/0253; F01C 2021/1643; F01C 2021/165

USPC ..... 418/55.1–55.6, 57, 104, 180, 270, 15; 417/229, 307, 308, 310, 440

See application file for complete search history.

(56) References Cited

U.S. PATENT DOCUMENTS

| | | | |
|---|---|---|---|
| 4,382,370 | A | 5/1983 | Suefuji et al. |
| 4,383,805 | A | 5/1983 | Teegarden et al. |
| 4,389,171 | A | 6/1983 | Eber et al. |
| 4,475,360 | A | 10/1984 | Suefuji et al. |
| 4,497,615 | A | 2/1985 | Griffith |
| 4,545,742 | A | 10/1985 | Schaefer |
| 4,609,329 | A | 9/1986 | Pillis et al. |
| 4,696,630 | A | 9/1987 | Sakata et al. |
| 4,727,725 | A | 3/1988 | Nagata et al. |
| 4,774,816 | A | 10/1988 | Uchikawa et al. |
| 4,818,195 | A | 4/1989 | Murayama et al. |
| 4,846,633 | A | 7/1989 | Suzuki et al. |
| 4,877,382 | A | 10/1989 | Caillat et al. |
| 4,886,425 | A | 12/1989 | Itahana et al. |
| 4,940,395 | A | 7/1990 | Yamamoto et al. |
| 5,055,010 | A | 10/1991 | Logan |
| 5,059,098 | A | 10/1991 | Suzuki et al. |
| 5,071,323 | A | 12/1991 | Sakashita et al. |
| 5,074,760 | A | 12/1991 | Hirooka et al. |
| 5,080,056 | A | 1/1992 | Kramer et al. |
| 5,085,565 | A | 2/1992 | Barito |
| RE34,148 | E | 12/1992 | Terauchi et al. |
| 5,169,294 | A | 12/1992 | Barito |
| 5,192,195 | A | 3/1993 | Iio et al. |
| 5,193,987 | A | 3/1993 | Iio et al. |
| 5,240,389 | A | 8/1993 | Oikawa et al. |
| 5,253,489 | A | 10/1993 | Yoshii |
| 5,356,271 | A | 10/1994 | Miura et al. |
| 5,451,146 | A | 9/1995 | Inagaki et al. |
| 5,482,637 | A | 1/1996 | Rao et al. |
| 5,551,846 | A | 9/1996 | Taylor et al. |
| 5,557,897 | A | 9/1996 | Kranz et al. |
| 5,562,426 | A | 10/1996 | Watanabe et al. |
| 5,577,897 | A | 11/1996 | Inagaki et al. |
| 5,607,288 | A | 3/1997 | Wallis et al. |
| 5,613,841 | A | 3/1997 | Bass et al. |
| 5,639,225 | A | 6/1997 | Matsuda et al. |
| 5,640,854 | A | 6/1997 | Fogt et al. |
| 5,674,058 | A | 10/1997 | Matsuda et al. |
| 5,678,985 | A | 10/1997 | Brooke et al. |
| 5,722,257 | A | 3/1998 | Ishii et al. |
| 5,741,120 | A | 4/1998 | Bass et al. |
| 5,855,475 | A | 1/1999 | Fujio et al. |
| 5,885,063 | A | 3/1999 | Makino et al. |
| 5,993,171 | A | 11/1999 | Higashiyama |
| 5,993,177 | A | 11/1999 | Terauchi et al. |
| 6,047,557 | A | 4/2000 | Pham et al. |
| 6,086,335 | A | 7/2000 | Bass et al. |
| 6,095,765 | A | 8/2000 | Khalifa |
| 6,102,671 | A | 8/2000 | Yamamoto et al. |
| 6,123,517 | A | 9/2000 | Brooke et al. |
| 6,123,528 | A | 9/2000 | Sun et al. |
| 6,132,179 | A | 10/2000 | Higashiyama |
| 6,139,287 | A | 10/2000 | Kuroiwa et al. |
| 6,139,291 | A | 10/2000 | Perevozchikov |
| 6,149,401 | A | 11/2000 | Iwanami et al. |
| 6,164,940 | A | 12/2000 | Terauchi et al. |
| 6,176,686 | B1 | 1/2001 | Wallis et al. |
| 6,179,589 | B1 | 1/2001 | Bass et al. |
| 6,202,438 | B1 | 3/2001 | Barito |
| 6,210,120 | B1 | 4/2001 | Hugenroth et al. |
| 6,213,731 | B1 | 4/2001 | Doepker et al. |
| 6,231,316 | B1 | 5/2001 | Wakisaka et al. |
| 6,273,691 | B1 | 8/2001 | Morimoto et al. |
| 6,293,767 | B1 | 9/2001 | Bass |
| 6,293,776 | B1 | 9/2001 | Hahn et al. |
| 6,322,340 | B1 | 11/2001 | Itoh et al. |
| 6,350,111 | B1 | 2/2002 | Perevozchikov et al. |
| 6,379,123 | B1 | 4/2002 | Makino et al. |
| 6,412,293 | B1 | 7/2002 | Pham et al. |
| 6,413,058 | B1 | 7/2002 | Williams et al. |
| 6,419,457 | B1 | 7/2002 | Seibel et al. |
| 6,428,286 | B1 | 8/2002 | Shimizu et al. |
| 6,454,551 | B2 | 9/2002 | Kuroki et al. |
| 6,457,948 | B1 | 10/2002 | Pham |
| 6,464,481 | B2 | 10/2002 | Tsubai et al. |
| 6,478,550 | B2 | 11/2002 | Matsuba et al. |
| 6,506,036 | B2 | 1/2003 | Tsubai et al. |
| 6,537,043 | B1 | 3/2003 | Chen |
| 6,544,016 | B2 | 4/2003 | Gennami et al. |
| 6,558,143 | B2 | 5/2003 | Nakajima et al. |
| 6,589,035 | B1 | 7/2003 | Tsubono et al. |
| 6,679,683 | B2 | 1/2004 | Seibel et al. |
| 6,715,999 | B2 | 4/2004 | Ancel et al. |
| 6,769,881 | B2 | 8/2004 | Lee |
| 6,769,888 | B2 | 8/2004 | Tsubono et al. |
| 6,773,242 | B1 | 8/2004 | Perevozchikov |
| 6,817,847 | B2 | 11/2004 | Agner |
| 6,821,092 | B1 | 11/2004 | Gehret et al. |
| 6,863,510 | B2 | 3/2005 | Cho |
| 6,881,046 | B2 | 4/2005 | Shibamoto et al. |
| 6,884,042 | B2 | 4/2005 | Zili et al. |
| 6,893,229 | B2 | 5/2005 | Choi et al. |
| 6,896,498 | B1 | 5/2005 | Patel |
| 6,913,448 | B2 | 7/2005 | Liang et al. |
| 6,984,114 | B2 | 1/2006 | Zili et al. |
| 7,018,180 | B2 | 3/2006 | Koo |
| 7,029,251 | B2 | 4/2006 | Chang et al. |
| 7,118,358 | B2 | 10/2006 | Tsubono et al. |
| 7,137,796 | B2 | 11/2006 | Tsubono et al. |
| 7,160,088 | B2 | 1/2007 | Peyton |
| 7,207,787 | B2 | 4/2007 | Liang et al. |
| 7,229,261 | B2 | 6/2007 | Morimoto et al. |
| 7,255,542 | B2 | 8/2007 | Lifson et al. |
| 7,261,527 | B2 | 8/2007 | Alexander et al. |
| 7,311,740 | B2 | 12/2007 | Williams et al. |
| 7,344,365 | B2 | 3/2008 | Takeuchi et al. |
| RE40,257 | E | 4/2008 | Doepker et al. |
| 7,354,259 | B2 | 4/2008 | Tsubono et al. |

(56) References Cited

U.S. PATENT DOCUMENTS

| | | | | |
|---|---|---|---|---|
| 7,364,416 | B2 | 4/2008 | Liang et al. | |
| 7,371,057 | B2 | 5/2008 | Shin et al. | |
| RE40,400 | E | 6/2008 | Bass et al. | |
| 7,393,190 | B2 | 7/2008 | Lee et al. | |
| 7,404,706 | B2 | 7/2008 | Ishikawa et al. | |
| RE40,554 | E | 10/2008 | Bass et al. | |
| 7,547,202 | B2 | 6/2009 | Knapke | |
| 7,717,687 | B2 | 5/2010 | Reinhart | |
| 7,771,178 | B2 | 8/2010 | Perevozchikov et al. | |
| 7,802,972 | B2 | 9/2010 | Shimizu et al. | |
| 7,891,961 | B2 | 2/2011 | Shimizu et al. | |
| RE42,371 | E | 5/2011 | Peyton | |
| 7,967,582 | B2 | 6/2011 | Akei et al. | |
| 7,967,583 | B2 | 6/2011 | Stover et al. | |
| 7,972,125 | B2 | 7/2011 | Stover et al. | |
| 7,976,295 | B2 | 7/2011 | Stover et al. | |
| 7,988,433 | B2 * | 8/2011 | Akei | F04C 18/0215 418/55.5 |
| 8,025,492 | B2 | 9/2011 | Seibel et al. | |
| 8,506,271 | B2 | 8/2013 | Seibel et al. | |
| 8,517,703 | B2 | 8/2013 | Doepker | |
| 8,585,382 | B2 * | 11/2013 | Akei | F04C 18/0215 418/55.5 |
| 8,616,014 | B2 | 12/2013 | Stover et al. | |
| 8,857,200 | B2 | 10/2014 | Stover et al. | |
| 9,127,677 | B2 | 9/2015 | Doepker | |
| 9,249,802 | B2 | 2/2016 | Doepker et al. | |
| 9,303,642 | B2 * | 4/2016 | Akei | F04C 18/0215 418/55.5 |
| 9,435,340 | B2 | 9/2016 | Doepker et al. | |
| 9,494,157 | B2 * | 11/2016 | Doepker | F04C 18/0215 418/55.5 |
| 2001/0010800 | A1 | 8/2001 | Kohsokabe et al. | |
| 2002/0039540 | A1 | 4/2002 | Kuroki et al. | |
| 2003/0044296 | A1 | 3/2003 | Chen | |
| 2003/0186060 | A1 | 10/2003 | Rao | |
| 2003/0228235 | A1 | 12/2003 | Sowa et al. | |
| 2004/0136854 | A1 | 7/2004 | Kimura et al. | |
| 2004/0146419 | A1 | 7/2004 | Kawaguchi et al. | |
| 2004/0184932 | A1 | 9/2004 | Lifson | |
| 2004/0197204 | A1 | 10/2004 | Yamanouchi et al. | |
| 2005/0019177 | A1 | 1/2005 | Shin et al. | |
| 2005/0019178 | A1 | 1/2005 | Shin et al. | |
| 2005/0053507 | A1 | 3/2005 | Takeuchi et al. | |
| 2005/0069444 | A1 | 3/2005 | Peyton | |
| 2005/0201883 | A1 | 9/2005 | Clendenin et al. | |
| 2005/0214148 | A1 | 9/2005 | Ogawa et al. | |
| 2006/0099098 | A1 | 5/2006 | Lee et al. | |
| 2006/0228243 | A1 | 10/2006 | Sun et al. | |
| 2006/0233657 | A1 | 10/2006 | Bonear et al. | |
| 2007/0036661 | A1 | 2/2007 | Stover | |
| 2007/0110604 | A1 | 5/2007 | Peyton | |
| 2007/0130973 | A1 | 6/2007 | Lifson et al. | |
| 2008/0159892 | A1 | 7/2008 | Huang et al. | |
| 2008/0196445 | A1 | 8/2008 | Lifson et al. | |
| 2008/0223057 | A1 | 9/2008 | Lifson et al. | |
| 2008/0305270 | A1 | 12/2008 | Uhlianuk et al. | |
| 2009/0035167 | A1 | 2/2009 | Sun | |
| 2009/0068048 | A1 | 3/2009 | Stover et al. | |
| 2009/0071183 | A1 | 3/2009 | Stover et al. | |
| 2009/0185935 | A1 | 7/2009 | Seibel et al. | |
| 2009/0297377 | A1 | 12/2009 | Stover et al. | |
| 2009/0297378 | A1 | 12/2009 | Stover et al. | |
| 2009/0297379 | A1 | 12/2009 | Stover et al. | |
| 2009/0297380 | A1 | 12/2009 | Stover et al. | |
| 2010/0111741 | A1 | 5/2010 | Chikano et al. | |
| 2010/0135836 | A1 | 6/2010 | Stover et al. | |
| 2010/0158731 | A1 | 6/2010 | Akei et al. | |
| 2010/0212311 | A1 | 8/2010 | McQuary et al. | |
| 2010/0254841 | A1 | 10/2010 | Akei et al. | |
| 2010/0300659 | A1 | 12/2010 | Stover et al. | |
| 2010/0303659 | A1 | 12/2010 | Stover et al. | |
| 2011/0135509 | A1 | 6/2011 | Fields et al. | |
| 2011/0206548 | A1 | 8/2011 | Daepker | |
| 2011/0293456 | A1 | 12/2011 | Seibel et al. | |
| 2012/0107163 | A1 | 5/2012 | Monnier et al. | |
| 2013/0078128 | A1 | 3/2013 | Akei | |
| 2013/0121857 | A1 | 5/2013 | Liang et al. | |
| 2013/0309118 | A1 | 11/2013 | Ginies et al. | |
| 2013/0315768 | A1 | 11/2013 | Le Coat et al. | |
| 2014/0023540 | A1 | 1/2014 | Heidecker et al. | |
| 2014/0024563 | A1 | 1/2014 | Heidecker et al. | |
| 2014/0037486 | A1 | 2/2014 | Stover et al. | |
| 2014/0134030 | A1 | 5/2014 | Stover et al. | |
| 2014/0134031 | A1 | 5/2014 | Doepker et al. | |
| 2014/0147294 | A1 | 5/2014 | Fargo et al. | |
| 2014/0154121 | A1 | 6/2014 | Doepker | |
| 2014/0154124 | A1 | 6/2014 | Doepker et al. | |
| 2015/0330386 | A1 * | 11/2015 | Doepker | F04C 18/0215 418/55.5 |

FOREIGN PATENT DOCUMENTS

| | | | |
|---|---|---|---|
| CN | 1289011 | A | 3/2001 |
| CN | 1382912 | A | 12/2002 |
| CN | 1517553 | A | 8/2004 |
| CN | 1680720 | A | 10/2005 |
| CN | 1702328 | A | 11/2005 |
| CN | 1963214 | A | 5/2007 |
| CN | 1995756 | A | 7/2007 |
| CN | 101358592 | A | 2/2009 |
| CN | 101761479 | A | 6/2010 |
| CN | 101806302 | A | 8/2010 |
| CN | 101910637 | A | 12/2010 |
| CN | 102076963 | A | 5/2011 |
| CN | 102449314 | A | 5/2012 |
| EP | 0822335 | A2 | 2/1998 |
| EP | 1067289 | A2 | 1/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| JP | 60259794 | | 12/1985 |
| JP | 63-205482 | | 8/1988 |
| JP | 03081588 | A | 4/1991 |
| JP | H07-293456 | A | 11/1995 |
| JP | H08247053 | A | 9/1996 |
| JP | 08334094 | A | 12/1996 |
| JP | H09-177689 | A | 7/1997 |
| JP | 11107950 | | 4/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 2003074481 | A | 3/2003 |
| JP | 2003074482 | A | 3/2003 |
| JP | 2003106258 | A | 4/2003 |
| JP | 2003227479 | A | 8/2003 |
| JP | 2007154761 | A | 6/2007 |
| JP | 2008248775 | A | 10/2008 |
| KR | 1019870000015 | | 5/1985 |
| KR | 870000015 | B1 | 1/1987 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101192642 | B1 | 10/2012 |
| WO | WO-0073659 | A1 | 12/2000 |
| WO | 2007046810 | A2 | 4/2007 |
| WO | WO-2009155099 | A2 | 12/2009 |
| WO | WO-2010118140 | A2 | 10/2010 |

OTHER PUBLICATIONS

First Office Action regarding Chinese Application No. 201380059666.8, dated Apr. 5, 2016. Translation provided by Unitalen Attorneys at Law.

First Office Action regarding Chinese Application No. 201380062614.6, dated Apr. 5, 2016. Translation provided by Unitalen Attorneys at Law.

(56) References Cited

OTHER PUBLICATIONS

Office Action regarding Chinese Patent Application No. 201380059963.2, dated May 10, 2016. Translation provided by Unitalen Attorneys at Law.
Office Action regarding Chinese Patent Application No. 201380062657.4, dated May 4, 2016. Translation provided by Unitalen Attorneys at Law.
Office Action regarding Chinese Patent Application No. 201410461048.2, dated Nov. 30, 2015. Translation provided by Unitalen Attorneys at Law.
Written Opinion of the International Searching Authority regarding Application No. PCT/US2010/030248, dated Nov. 26, 2010.
International Search Report regarding Application No. PCT/US2010/030248, dated Nov. 26, 2010.
International Search Report regarding Application No. PCT/US2011/025921, dated Oct. 7, 2011.
Written Opinion of the International Search Authority regarding Application No. PCT/US2011/025921, dated Oct. 7, 2011.
China Office Action regarding Application No. 201080020243.1 dated Nov. 5, 2013. Translation provided by Unitalen Attorneys At Law.
U.S. Office Action regarding U.S. Appl. No. 13/181,065 dated Nov. 9, 2012.
U.S. Appl. No. 14/060,240, filed Oct. 22, 2013.
U.S. Office Action regarding U.S. Appl. No. 11/645,288 dated Nov. 30, 2009.
Extended European Search Report regarding Application No. EP07254962 dated Mar. 12, 2008.
First China Office Action regarding Application No. 200710160038.5 dated Jul. 8, 2010. Translation provided by Unitalen Attorneys At Law.
China Office Action regarding Application No. 200710160038.5 dated Jan. 31, 2012. Translation provided by Unitalen Attorneys At Law.
U.S. Appl. No. 14/073,246, filed Nov. 6, 2013.
U.S. Appl. No. 14/073,293, filed Nov. 6, 2013.
International Search Report regarding Application No. PCT/US2013/069462, dated Feb. 21, 2014.
Written Opinion of the Internation Searching Authority regarding Application No. PCT/US2013/069462, dated Feb. 21, 2014.
International Search Report regarding Application No. PCT/US2013/070981, dated Mar. 4, 2014.
Written Opinion of the International Searching Authority regarding Application No. PCT/US2013/070981, dated Mar. 4, 2014.
International Search Report regarding Application No. PCT/US2013/069456, dated Feb. 18, 2014.
Written Opinion of the International Searching Authority regarding Application No. PCT/US2013/069456, dated Feb. 18, 2014.
International Search Report regarding Application No. PCT/US2013/070992, dated Feb. 25, 2014.
Written Opinion of the International Searching Authority regarding Application No. PCT/US2013/070992, dated Feb. 25, 2014.
Second Office Action regarding China Application No. 201180010366.1 dated Dec. 31, 2014. Translation provided by Unitalen Attorneys At Law.
U.S. Appl. No. 14/060,102, filed Oct. 22, 2013.
International Search Report regarding International Application No. PCT/US2015/033960, dated Sep. 1, 2015.
Written Opinion of the International Searching Authority regarding International Application No. PCT/US2015/033960, dated Sep. 1, 2015.
Search Report regarding European Patent Application No. 10762374.6-1608 / 2417356 PCT/US2010030248, dated Jun. 16, 2015.
Office Action regarding U.S. Appl. No. 14/060,240, dated Aug. 12, 2015.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding Chinese Patent Application No. 201410460792.0, dated Feb. 25, 2016. Translation provided by Unitalen Attorneys at Law.
International Search Report regarding Application No. PCT/US2013/051678, dated Oct. 21, 2013.
Written Opinion of the International Searching Authority regarding Application No. PCT/US2013/051678, dated Oct. 21, 2013.
Office Action regarding U.S. Appl. No. 14/081,390, dated Mar. 27, 2015.
Office Action regarding U.S. Appl. No. 14/073,293, dated Sep. 25, 2015.
Restriction Requirement regarding U.S. Appl. No. 14/060,102, dated Oct. 7, 2015.
Interview Summary regarding U.S. Appl. No. 14/060,240, dated Dec. 1, 2015.
Office Action regarding U.S. Appl. No. 14/073,293, dated Jan. 29, 2016.
Restriction Requirement regarding U.S. Appl. No. 14/060,102, dated Mar. 16, 2016.
Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys At Law.
Search Report regarding European Patent Application No. 11747996.4, dated Nov. 7, 2016.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.

* cited by examiner

COMPRESSOR HAVING CAPACITY MODULATION ASSEMBLY

CROSS-REFERENCE TO RELATED APPLICATION

This application is a continuation of U.S. patent application Ser. No. 14/081,390, filed on Nov. 15, 2013, which is a continuation of U.S. patent application Ser. No. 13/181,065, filed on Jul. 12, 2011, which is a continuation of U.S. patent application Ser. No. 12/754,920, filed on Apr. 6, 2010, which claims the benefit of U.S. Provisional Application No. 61/167,309, filed on Apr. 7, 2009. The entire disclosures of each of the above applications are incorporated herein by reference.

FIELD

The present disclosure relates to compressor capacity modulation assemblies.

BACKGROUND

This section provides background information related to the present disclosure and which is not necessarily prior art.

Compressors may be designed for a variety of operating conditions. The operating conditions may require different output from the compressor. In order to provide for more efficient compressor operation, a capacity modulation assembly may be included in a compressor to vary compressor output depending on the operating condition.

SUMMARY

This section provides a general summary of the disclosure, and is not comprehensive of its full scope or all of its features.

In one form, the present disclosure provides a compressor that may include a shell assembly, first and second scroll members, a seal assembly, a modulation control chamber and a modulation control valve. The shell assembly may define a suction pressure region and a discharge pressure region. The first scroll member may be disposed within the shell assembly and may include a first end plate having a discharge passage, a first spiral wrap extending from the first end plate and a biasing passage extending through the first end plate. The second scroll member may be disposed within the shell assembly and may include a second end plate having a second spiral wrap extending therefrom. The first and second spiral wraps may meshingly engage each other and form a series of pockets therebetween. The seal assembly may engage the first scroll member and may isolate the discharge pressure region from the suction pressure region. The seal assembly and the first scroll member may define an axial biasing chamber therebetween. The biasing passage may be in communication with a first of said pockets and the axial biasing chamber. The modulation control chamber may be fluidly coupled with the axial biasing chamber by a first passage. The modulation control valve may be fluidly coupled with the modulation control chamber by a second passage and may be movable between a first position allowing communication between the second passage and the suction pressure region and a second position restricting communication between the second passage and the suction pressure region.

In another form, the present disclosure provides a compressor that may include a shell assembly, first and second scroll members, a seal assembly, a modulation control chamber and a modulation control valve. The shell assembly may define a suction pressure region and a discharge pressure region. The first scroll member may be disposed within the shell assembly and may include a first end plate having a discharge passage, a first spiral wrap extending from the first end plate and a biasing passage extending through the first end plate. The second scroll member may be disposed within the shell assembly and may include a second end plate having a second spiral wrap extending therefrom. The first and second spiral wraps may be meshingly engaged with each other and may form a series of pockets therebetween. The seal assembly may engage the first scroll member and may isolate the discharge pressure region from the suction pressure region. The seal assembly and the first scroll member may define an axial biasing chamber therebetween. The biasing passage may be in communication with a first of the pockets and the axial biasing chamber. The modulation control chamber may be fluidly coupled with the axial biasing chamber. The modulation control valve may be fluidly coupled with the modulation control chamber and may be movable between a first position allowing communication fluid to flow from the axial biasing chamber and into the suction pressure region via the modulation control chamber and a second position restricting communication between the axial biasing chamber and the suction pressure region.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
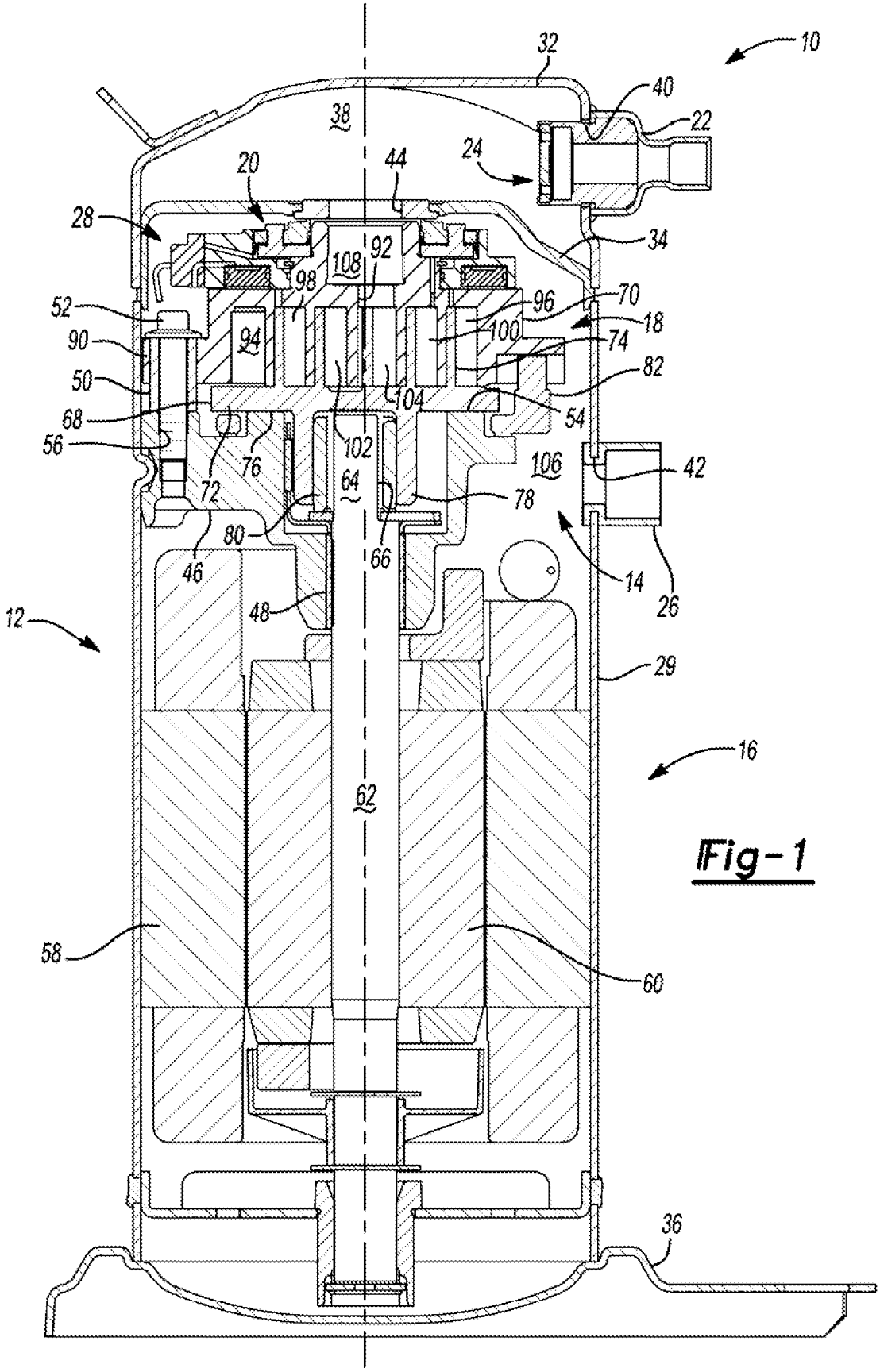
FIG. 1 is a section view of a compressor according to the present disclosure.

The following description is merely exemplary in nature and is not intended to limit the present disclosure, application, or uses. It should be understood that throughout the drawings, corresponding reference numerals indicate like or corresponding parts and features.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 may include a hermetic shell assembly 12, a bearing housing assembly 14, a motor assembly 16, a compression mechanism 18, a seal assembly 20, a refrigerant discharge fitting 22, a discharge valve assembly 24, a suction gas inlet fitting 26, and a capacity modulation assembly 28. Shell assembly 12 may house bearing housing assembly 14, motor assembly 16, compression mechanism 18, and capacity modulation assembly 28.

Shell assembly 12 may generally form a compressor housing and may include a cylindrical shell 29, an end cap 32 at the upper end thereof, a transversely extending partition 34, and a base 36 at a lower end thereof. End cap 32 and partition 34 may generally define a discharge chamber 38. Discharge chamber 38 may generally form a discharge muffler for compressor 10. While illustrated as including discharge chamber 38, it is understood that the present disclosure applies equally to direct discharge configurations. Refrigerant discharge fitting 22 may be attached to shell assembly 12 at opening 40 in end cap 32. Discharge valve assembly 24 may be located within discharge fitting 22 and may generally prevent a reverse flow condition. Suction gas inlet fitting 26 may be attached to shell assembly 12 at opening 42. Partition 34 may include a discharge passage 44 therethrough providing communication between compression mechanism 18 and discharge chamber 38.

Bearing housing assembly 14 may be affixed to shell 29 at a plurality of points in any desirable manner, such as staking. Bearing housing assembly 14 may include a main bearing housing 46, a bearing 48 disposed therein, bushings 50, and fasteners 52. Main bearing housing 46 may house bearing 48 therein and may define an annular flat thrust bearing surface 54 on an axial end surface thereof. Main bearing housing 46 may include apertures 56 extending therethrough and receiving fasteners 52.

Motor assembly 16 may generally include a motor stator 58, a rotor 60, and a drive shaft 62. Motor stator 58 may be press fit into shell 29. Drive shaft 62 may be rotatably driven by rotor 60 and may be rotatably supported within first bearing 48. Rotor 60 may be press fit on drive shaft 62. Drive shaft 62 may include an eccentric crank pin 64 having a flat 66 thereon.

Compression mechanism 18 may generally include an orbiting scroll 68 and a non-orbiting scroll 70. Orbiting scroll 68 may include an end plate 72 having a spiral vane or wrap 74 on the upper surface thereof and an annular flat thrust surface 76 on the lower surface. Thrust surface 76 may interface with annular flat thrust bearing surface 54 on main bearing housing 46. A cylindrical hub 78 may project downwardly from thrust surface 76 and may have a drive bushing 80 rotatably disposed therein. Drive bushing 80 may include an inner bore in which crank pin 64 is drivingly disposed. Crank pin flat 66 may drivingly engage a flat surface in a portion of the inner bore of drive bushing 80 to provide a radially compliant driving arrangement. An Oldham coupling 82 may be engaged with the orbiting and non-orbiting scrolls 68, 70 to prevent relative rotation therebetween.

Figure 2:
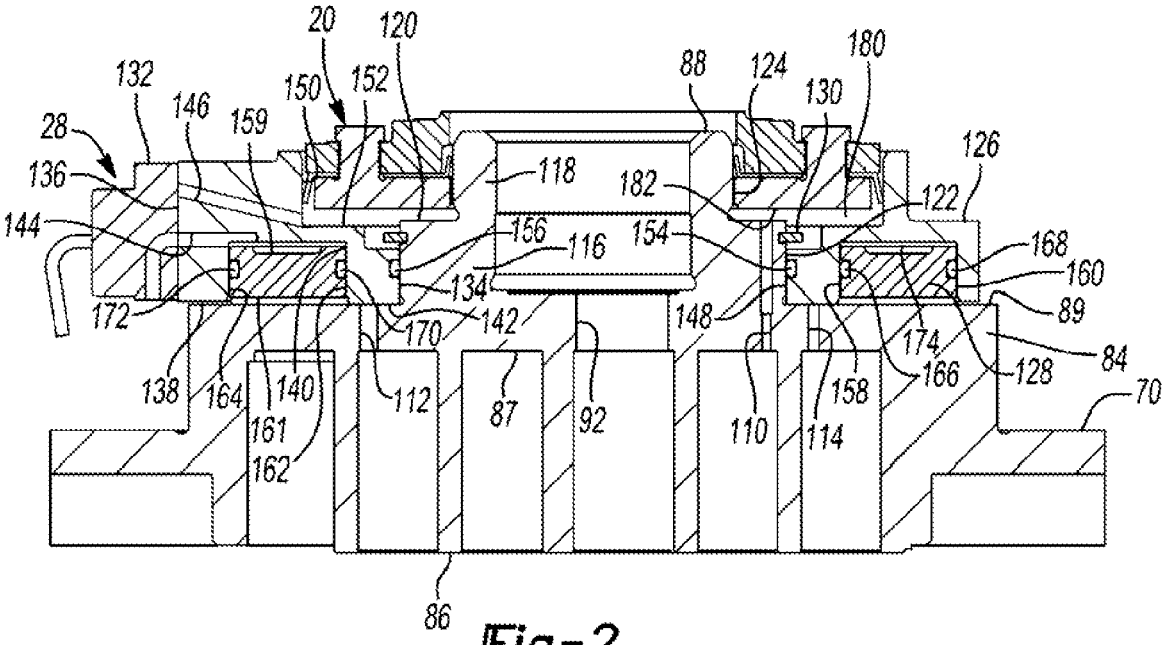
FIG. 2 is a section view of the non-orbiting scroll member and capacity modulation assembly of FIG. 1 in a first operating mode.
Figure 3:
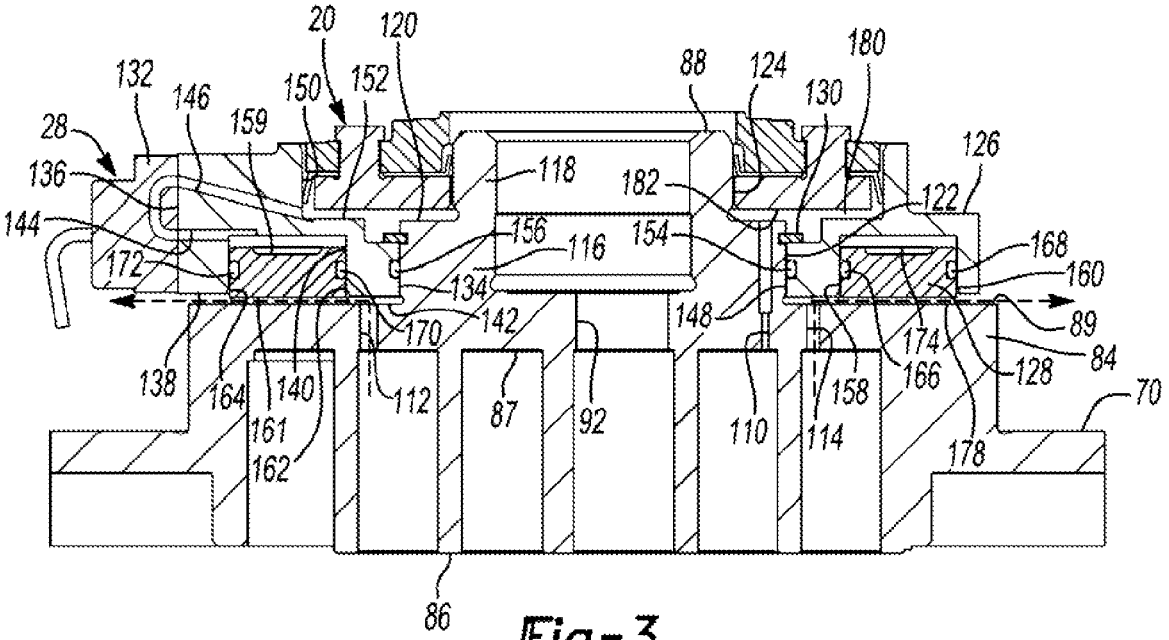
FIG. 3 is a section view of the non-orbiting scroll member and capacity modulation assembly of FIG. 1 in a second operating mode.
Figure 4:
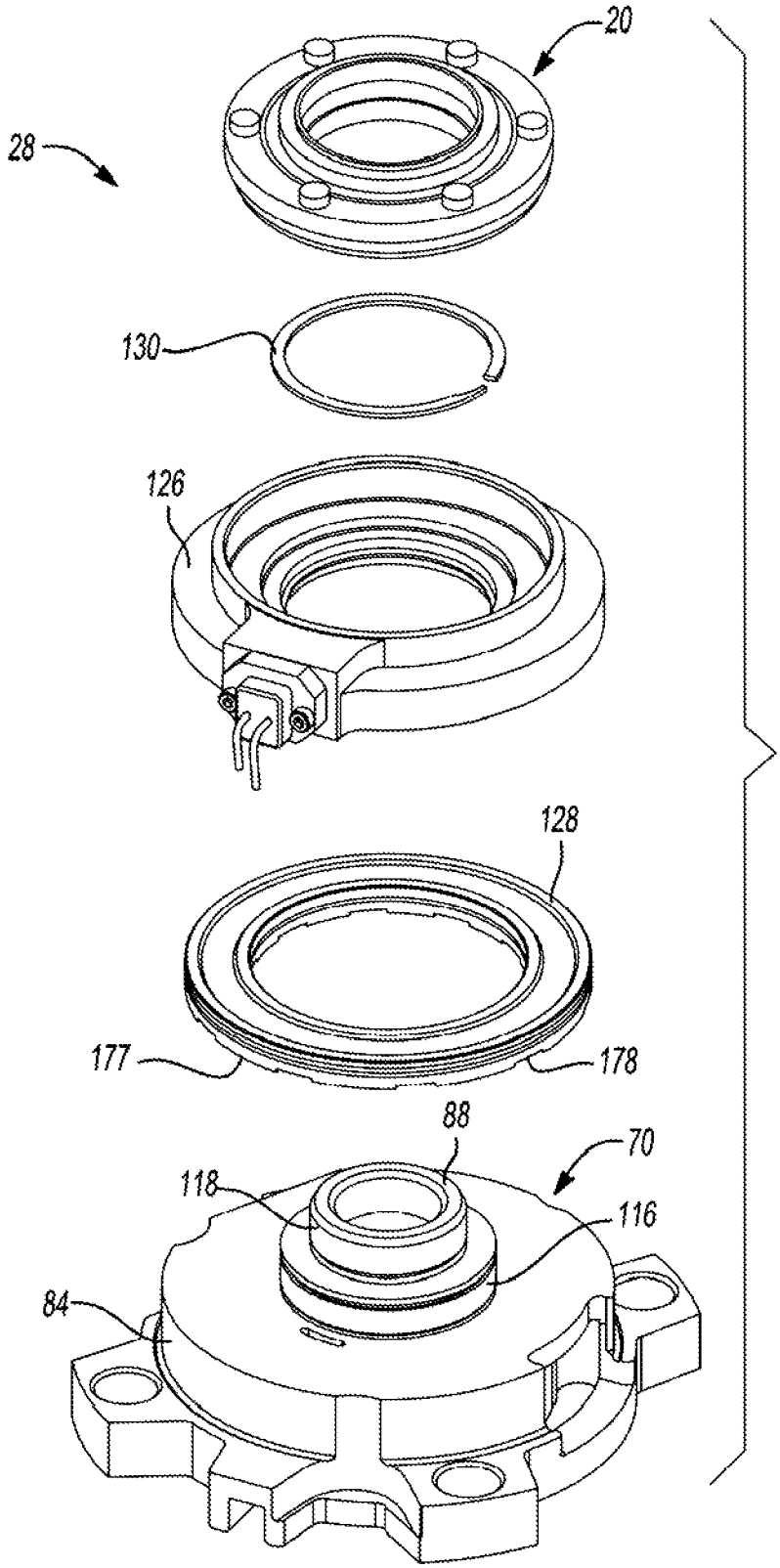
FIG. 4 is a perspective exploded view of the non-orbiting scroll member and capacity modulation assembly of FIG. 1.

With additional reference to FIGS. 2-4, non-orbiting scroll 70 may include an end plate 84 defining a discharge passage 92 and having a spiral wrap 86 extending from a first side 87 thereof, an annular hub 88 extending from a second side 89 thereof opposite the first side, and a series of radially outwardly extending flanged portions 90 (FIG. 1) engaged with fasteners 52. Fasteners 52 may rotationally fix non-orbiting scroll 70 relative to main bearing housing 46 while allowing axial displacement of non-orbiting scroll 70 relative to main bearing housing 46. Spiral wraps 74, 86 may be meshingly engaged with one another defining pockets 94, 96, 98, 100, 102, 104 (FIG. 1). It is understood that pockets 94, 96, 98, 100, 102, 104 change throughout compressor operation.

A first pocket, pocket 94 in FIG. 1, may define a suction pocket in communication with a suction pressure region 106 of compressor 10 operating at a suction pressure ($P_s$) and a second pocket, pocket 104 in FIG. 1, may define a discharge pocket in communication with a discharge pressure region 108 of compressor 10 operating at a discharge pressure ($P_d$) via discharge passage 92. Pockets intermediate the first and second pockets, pockets 96, 98, 100, 102 in FIG. 1, may form intermediate compression pockets operating at intermediate pressures between the suction pressure ($P_s$) and the discharge pressure ($P_d$).

Referring again to FIGS. 2-4, end plate 84 may additionally include a biasing passage 110 and first and second modulation ports 112, 114. Biasing passage 110 and first and second modulation ports 112, 114 may each be in fluid communication with one of the intermediate compression pockets. Biasing passage 110 may be in fluid communication with one of the intermediate compression pockets operating at a higher pressure than ones of intermediate compression pockets in fluid communication with first and second modulation ports 112, 114.

Annular hub 88 may include first and second portions 116, 118 axially spaced from one another forming a stepped region 120 therebetween. First portion 116 may be located axially between second portion 118 and end plate 84 and may have an outer radial surface 122 defining a first diameter ($D_1$) greater than or equal to a second diameter ($D_2$) defined by an outer radial surface 124 of second portion 118.

Capacity modulation assembly 28 may include a modulation valve ring 126, a modulation lift ring 128, a retaining ring 130, and a modulation control valve assembly 132. Modulation valve ring 126 may include an inner radial surface 134, an outer radial surface 136, a first axial end surface 138 defining an annular recess 140 and a valve portion 142, and first and second passages 144, 146. Inner radial surface 134 may include first and second portions 148, 150 defining a second axial end surface 152 therebetween. First portion 148 may define a third diameter ($D_3$) less than a fourth diameter ($D_4$) defined by the second portion 150. The first and third diameters ($D_1$, $D_3$) may be approximately equal to one another and the first portions 116, 148 may be sealingly engaged with one another via a seal 154 located radially therebetween. More specifically, seal 154 may include an o-ring seal and may be located within an annular recess 156 in first portion 148 of modulation valve ring 126. Alternatively, the o-ring seal could be located in an annular recess in annular hub 88.

Modulation lift ring 128 may be located within annular recess 140 and may include an annular body defining inner and outer radial surfaces 158, 160, and first and second axial end surfaces 159, 161. Inner and outer radial surfaces 158, 160 may be sealingly engaged with sidewalls 162, 164 of annular recess 140 via first and second seals 166, 168. More specifically, first and second seals 166, 168 may include o-ring seals and may be located within annular recesses 170, 172 in inner and outer radial surfaces 158, 160 of modulation lift ring 128. Modulation valve ring 126 and modulation lift ring 128 may cooperate to define a modulation control chamber 174 between annular recess 140 and first axial end surface 159. First passage 144 may be in fluid communication with modulation control chamber 174. Second axial end surface 161 may face end plate 84 and may include a series of protrusions 177 defining radial flow passages 178 therebetween.

Seal assembly 20 may form a floating seal assembly and may be sealingly engaged with non-orbiting scroll 70 and modulation valve ring 126 to define an axial biasing chamber 180. More specifically, seal assembly 20 may be sealingly engaged with outer radial surface 124 of annular hub 88 and second portion 150 of modulation valve ring 126. Axial biasing chamber 180 may be defined axially between an axial end surface 182 of seal assembly 20 and second axial end surface 152 of modulation valve ring 126 and stepped region 120 of annular hub 88. Second passage 146 may be in fluid communication with axial biasing chamber 180.

Retaining ring 130 may be axially fixed relative to non-orbiting scroll 70 and may be located within axial biasing chamber 180. More specifically, retaining ring 130 may be located within a recess in first portion 116 of annular hub 88 axially between seal assembly 20 and modulation valve ring 126. Retaining ring 130 may form an axial stop for modulation valve ring 126. Modulation control valve assembly 132 may include a solenoid operated valve and may be in fluid communication with first and second passages 144, 146 in modulation valve ring 126 and suction pressure region 106.

Figure 12:
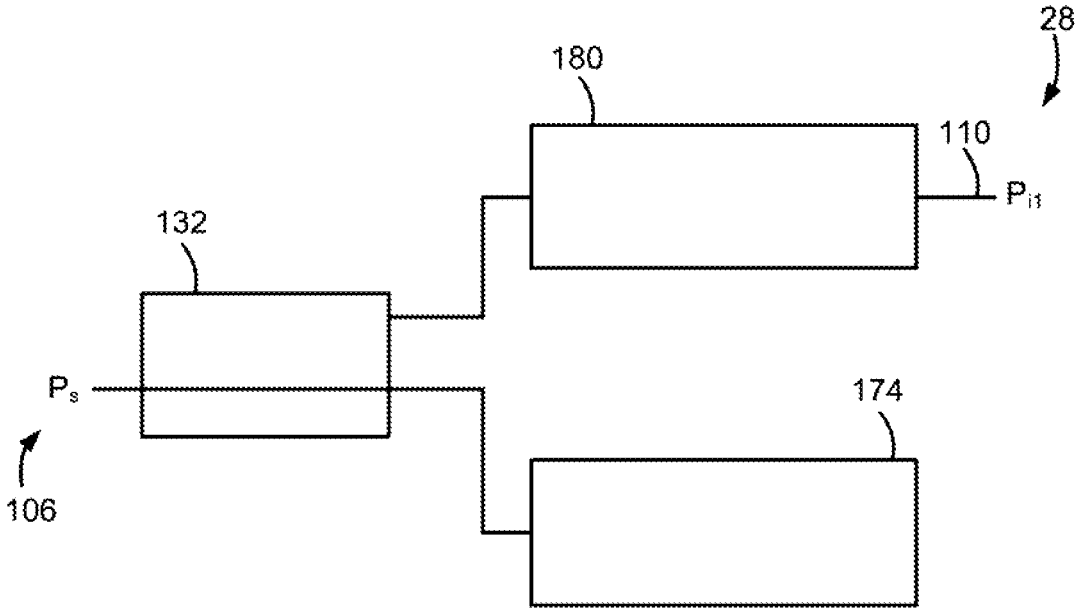
FIG. 12 is a schematic illustration of the capacity modulation assembly of FIG. 2 in the first operating mode.
Figure 13:
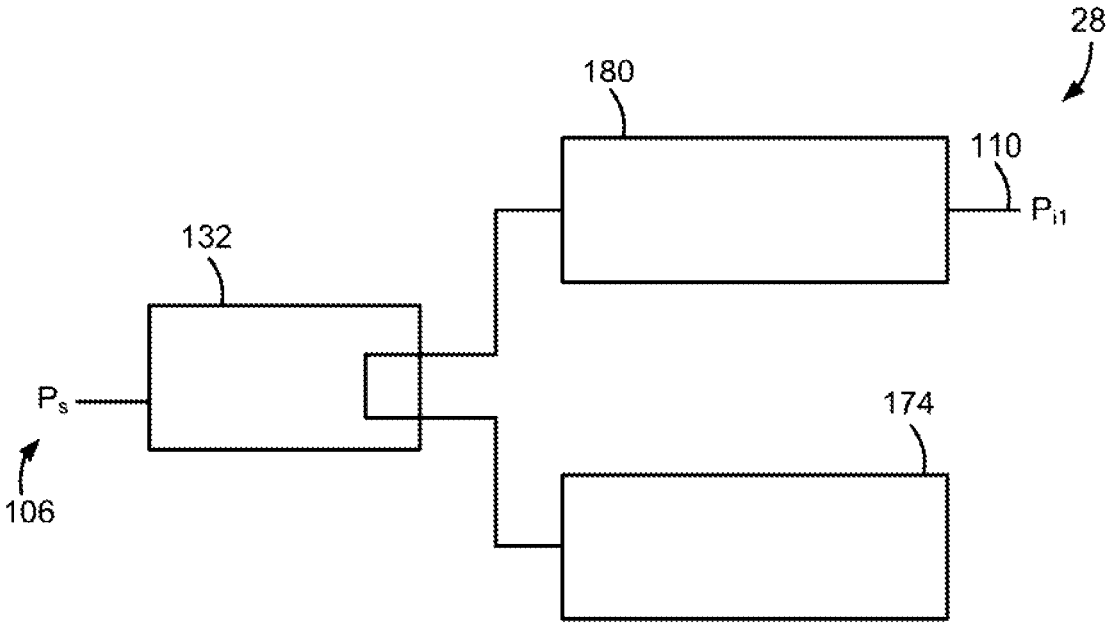
FIG. 13 is a schematic illustration of the capacity modulation assembly of FIG. 3 in the second operating mode.

With additional reference to FIGS. 12 and 13, during compressor operation, modulation control valve assembly 132 may be operated in first and second modes. FIGS. 12 and 13 schematically illustrate operation of modulation control valve assembly 132. In the first mode, seen in FIGS. 2 and 12, modulation control valve assembly 132 may provide fluid communication between modulation control chamber 174 and suction pressure region 106. More specifically, modulation control valve assembly 132 may provide fluid communication between first passage 144 and suction pressure region 106 during operation in the first mode. In the second mode, seen in FIGS. 3 and 13, modulation control valve assembly 132 may provide fluid communication between modulation control chamber 174 and axial biasing chamber 180. More specifically, modulation control valve assembly 132 may provide fluid communication between first and second passages 144, 146 during operation in the second mode.

Figure 14:
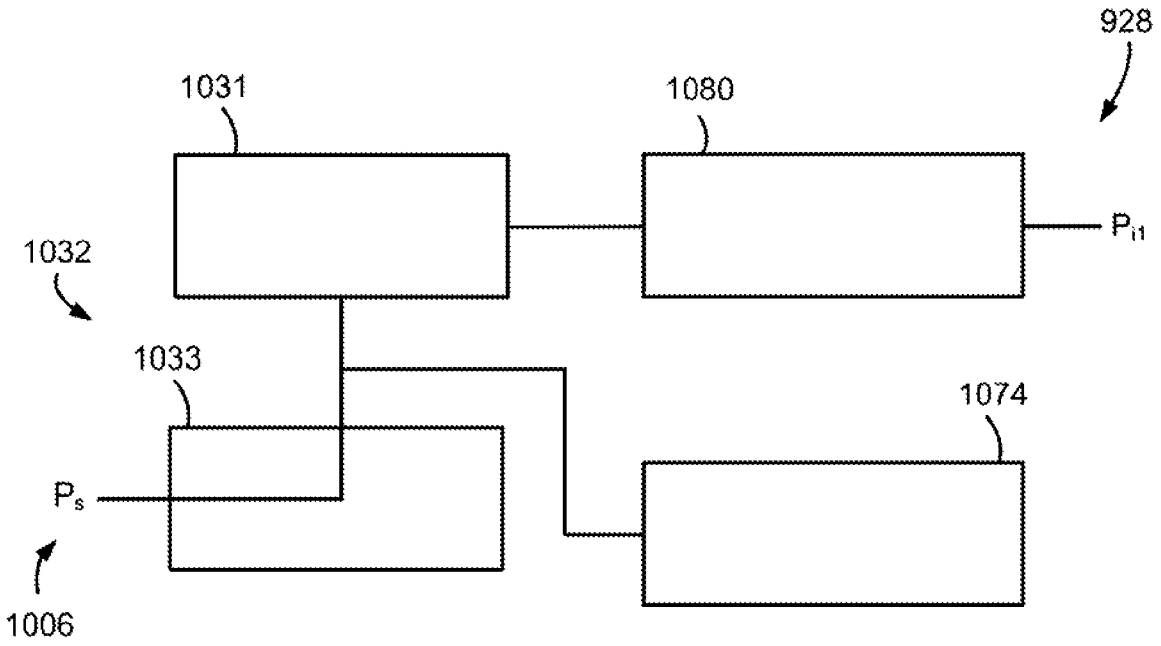
FIG. 14 is a schematic illustration of an alternate capacity modulation assembly in the first operating mode.
Figure 15:
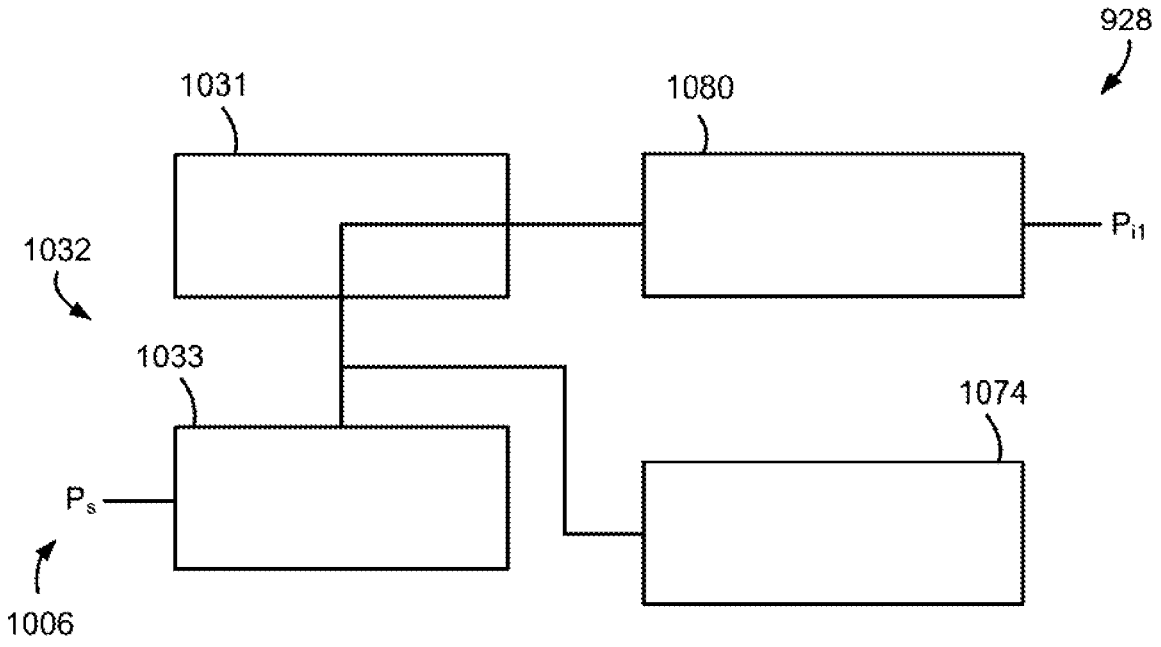
FIG. 15 is a schematic illustration of the alternate capacity modulation assembly of FIG. 14 in the second operating mode.

In an alternate capacity modulation assembly 928, seen in FIGS. 14 and 15, a modulation control valve assembly 1032 may include first and second modulation control valves 1031, 1033. Capacity modulation assembly 928 may be incorporated into compressor 10 as discussed below. First modulation control valve 1031 may be in communication with modulation control chamber 1074, biasing chamber 1080, and second modulation control valve 1033. Second modulation control valve 1033 may be in communication with suction pressure region 1006, first modulation control valve 1031, and modulation control chamber 1074. Modulation control valve assembly 1032 may be operated in first and second modes.

In the first mode, seen in FIG. 14, first modulation control valve 1031 may be closed, isolating modulation control chamber 1074 from biasing chamber 1080, and second modulation control valve 1033 may be open, providing communication between modulation control chamber 1074 and suction pressure region 1006. In the second mode, seen in FIG. 15, first modulation control valve 1031 may be open, providing communication between modulation control chamber 1074 and biasing chamber 1080, and second modulation control valve 1033 may be closed, isolating modulation control chamber 1074 from suction pressure region 1006.

Modulation control valve assembly 1032 may be modulated between the first and second modes to create a compressor operating capacity that is between a fully loaded capacity (first mode) and a part loaded capacity (second mode). Pulse-width-modulation of the opening and closing of first and second modulation control valves 1031, 1033 may be utilized to create this intermediate capacity. Second modulation control valve 1033 may be open during the first mode as seen in FIG. 14. Alternatively, second modulation control valve 1033 may be opened, for example, between 0.2 and 1.0 seconds when transitioning from the second mode to the first mode and then closed to be ready for transitioning to the second mode. This allows the modulation control chamber 1074 to reach suction pressure ($P_s$) to allow compressor operation in the first mode.

Figure 30:
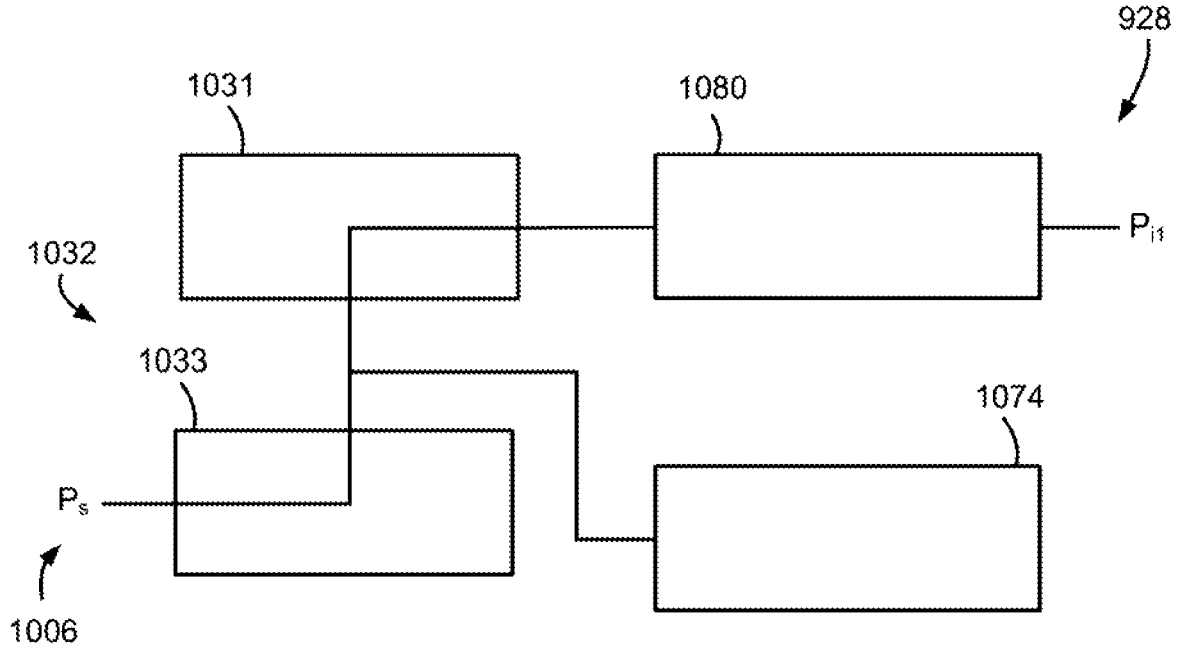
FIG. 30 is a schematic illustration of the capacity modulation assembly of FIGS. 14 and 15 in a third operating mode.

Alternatively, modulation control valve assembly 1032 may be modulated between the second mode and a third mode. The third mode is schematically illustrated in FIG. 30 and provides an unloaded (zero capacity) condition. In the third mode, first and second modulation control valves 1031, 1033 may be open. Therefore, modulation control chamber 1074 and biasing chamber 1080 are both in communication with suction pressure region 1006. Modulation control valve assembly 1032 may be modulated between the second and third modes to create a compressor operating capacity that is between the part loaded capacity (second mode) and the unloaded capacity (third mode). Pulse-width-modulation of the opening and closing of first and second modulation control valves 1031, 1033 may be utilized to create this intermediate capacity.

Alternatively, modulation control valve assembly 1032 may be modulated between the first and third modes to create a compressor operating capacity that is between the fully loaded capacity (first mode) and the unloaded capacity (third mode). Pulse-width-modulation of the opening and closing of first and second modulation control valves 1031, 1033 may be utilized to create this intermediate capacity. When transitioning from the third mode to the first mode, second modulation control valve 1033 may remain open and first modulation control valve 1031 may be modulated between opened and closed positions. Alternatively, second modulation control valve 1033 may be closed when transitioning from the third mode to the first mode. In such arrangements, second modulation control valve 1033 may be closed after first modulation control valve 1031 by a delay (e.g., less than one second) to ensure that modulation control chamber 1074 is maintained at suction pressure ($P_s$) and does not experience additional biasing pressure ($P_{i1}$).

Figure 16:
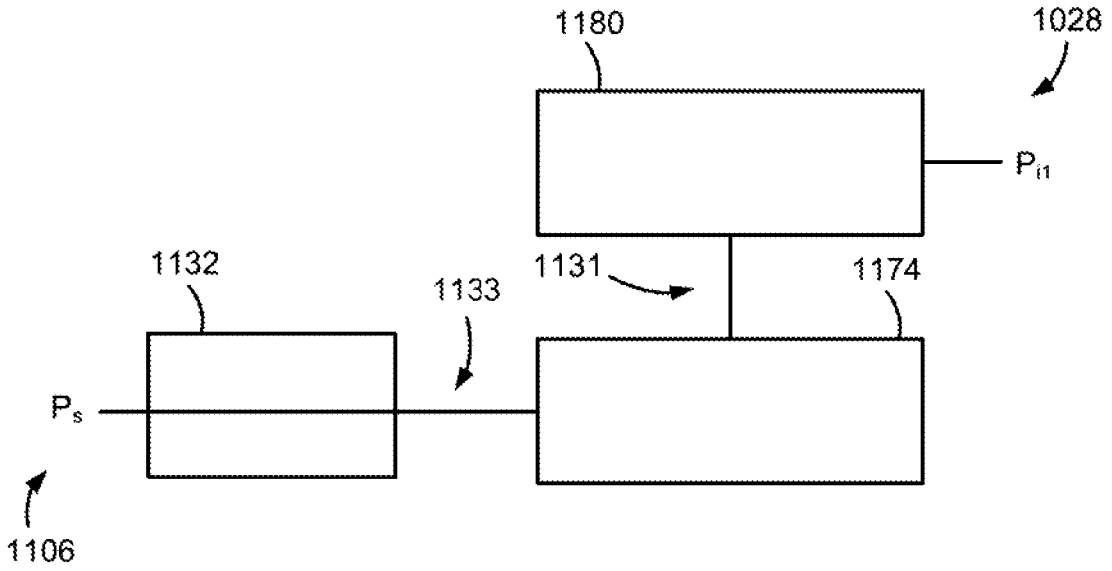
FIG. 16 is a schematic illustration of an alternate capacity modulation assembly in the first operating mode.
Figure 17:
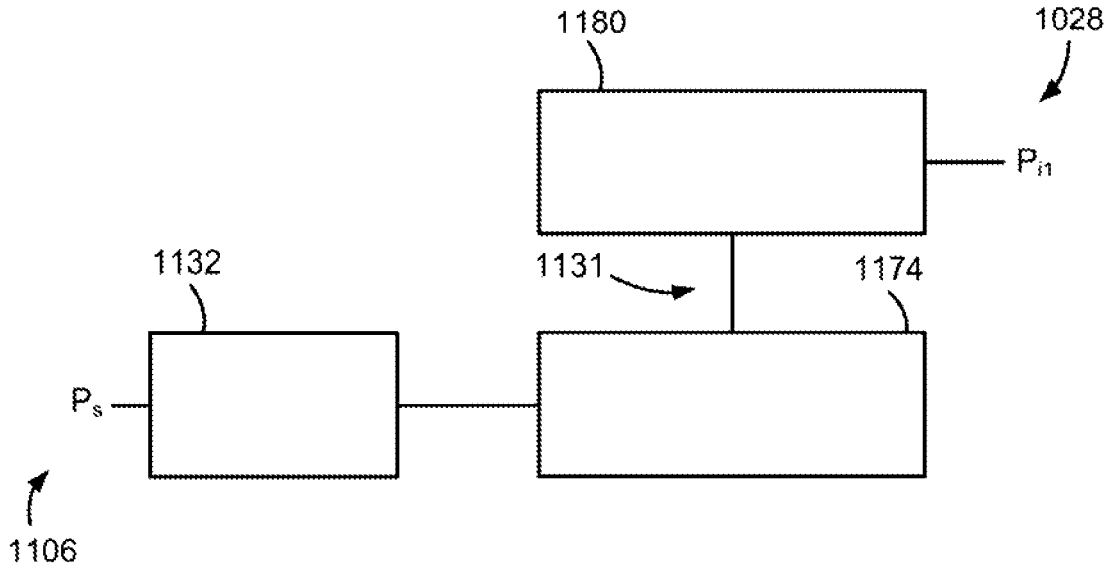
FIG. 17 is a schematic illustration of the alternate capacity modulation assembly of FIG. 16 in the second operating mode.

An alternate capacity modulation assembly 1028 is shown in FIGS. 16 and 17. Capacity modulation assembly 1028 may be incorporated into compressor 10 as discussed below. In the arrangement of FIGS. 16 and 17, modulation control chamber 1174 may be in communication with biasing chamber 1180 via a first passage 1131. Modulation control valve assembly 1132 may be in communication with modulation control chamber 1174 and suction pressure region 1106. Modulation control valve assembly 1132 may be operated in first and second modes.

In the first mode, seen in FIG. 16, modulation control valve assembly 1132 may be open, providing communication between modulation control chamber 1174 via a second passage 1133. First passage 1131 may define a greater flow restriction than second passage 1133. The greater flow restriction of first passage 1131 relative to second passage 1133 may generally prevent a total loss of biasing pressure within biasing chamber 1180 during the first mode. In the second mode, seen in FIG. 17, modulation control valve assembly 1132 may be closed, isolating modulation control chamber 1174 from suction pressure region 1106.

Figure 18:
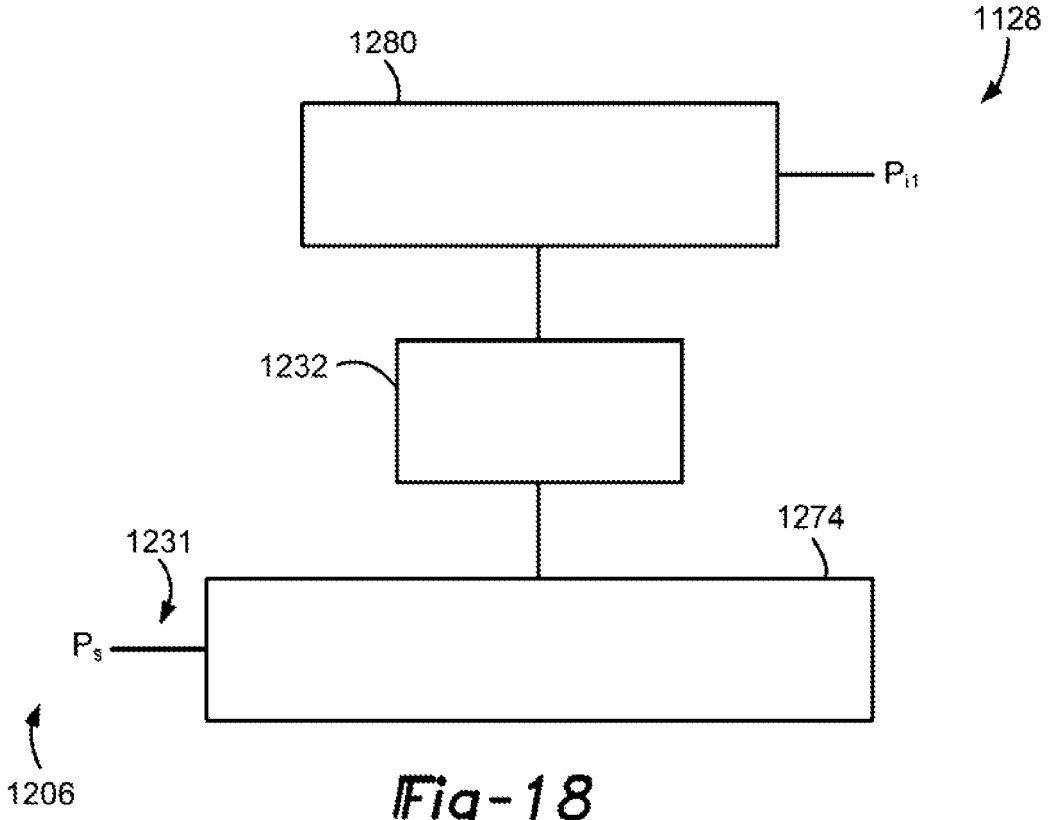
FIG. 18 is a schematic illustration of an alternate capacity modulation assembly in the first operating mode.
Figure 19:
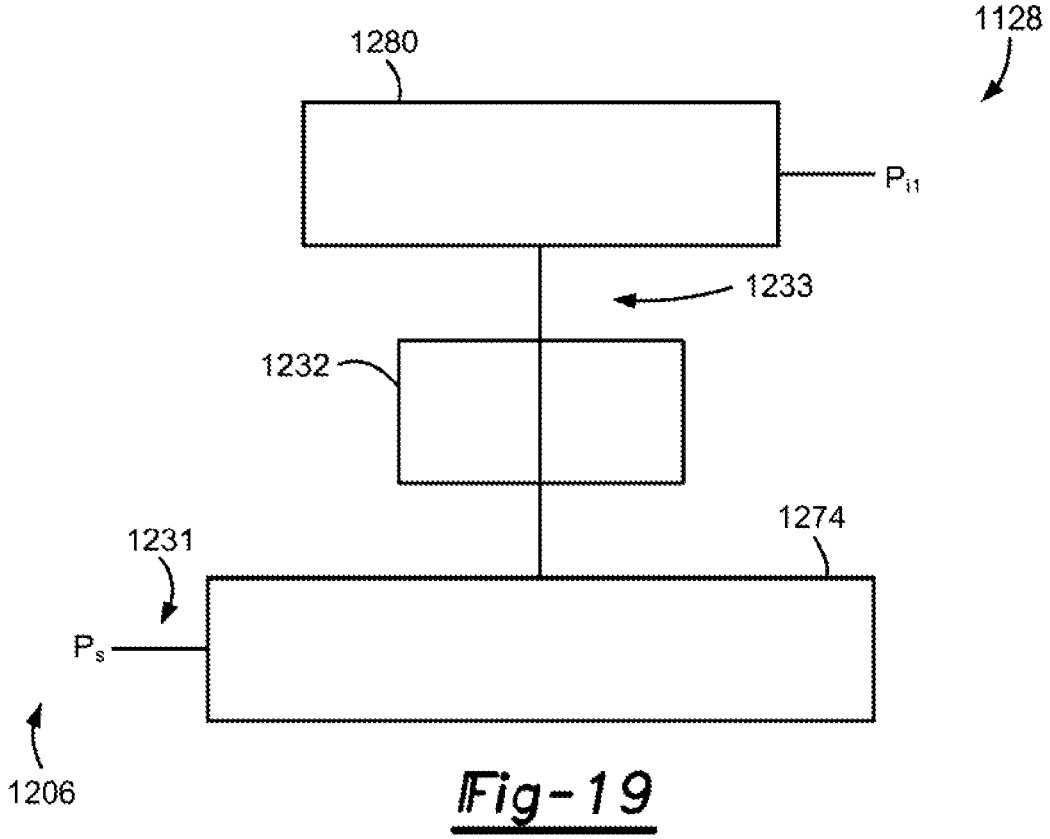
FIG. 19 is a schematic illustration of the alternate capacity modulation assembly of FIG. 18 in the second operating mode.

Another alternate capacity modulation assembly 1128 is shown in FIGS. 18 and 19. Capacity modulation assembly 1128 may be incorporated into compressor 10 as discussed below. In the arrangement of FIGS. 18 and 19, modulation control chamber 1274 may be in communication with suction pressure region 1206 via a first passage 1231. Modulation control valve assembly 1232 may be in communication with modulation control chamber 1274 and biasing chamber 1280. Modulation control valve assembly 1232 may be operated in first and second modes.

In the first mode, seen in FIG. 18, modulation control valve assembly 1232 may be closed, isolating modulation control chamber 1274 from biasing chamber 1280. In the second mode, seen in FIG. 19, modulation control valve assembly 1232 may be open, providing communication between modulation control chamber 1274 and biasing chamber 1280 via a second passage 1233. First passage 1231 may define a greater flow restriction than second passage 1233. The greater flow restriction of first passage 1231 relative to second passage 1233 may generally prevent a total loss of biasing pressure within biasing chamber 1280 during the second mode.

Modulation valve ring 126 may define a first radial surface area ($A_1$) facing away from non-orbiting scroll 70 radially between first and second portions 148, 150 of inner radial surface 134 of modulation valve ring 126 ($A_1=(\pi)(D_4^2-D_3^2)/4$). Inner sidewall 162 may define a diameter ($D_5$) less than a diameter ($D_6$) defined by outer sidewall 164. Modulation valve ring 126 may define a second radial surface area ($A_2$) opposite first radial surface area ($A_1$) and facing non-orbiting scroll 70 radially between sidewalls 162, 164 of inner radial surface 134 of modulation valve ring 126 ($A_2=(\pi)(D_6^2-D_5^2)/4$). First radial surface area ($A_1$) may be less than second radial surface area ($A_2$). Modulation valve ring 126 may be displaced between first and second positions based on the pressure provided to modulation control chamber 174 by modulation control valve assembly 132. Modulation valve ring 126 may be displaced by fluid pressure acting directly thereon, as discussed below.

A first intermediate pressure ($P_{i1}$) within axial biasing chamber 180 applied to first radial surface area ($A_1$) may provide a first axial force ($F_1$) urging modulation valve ring 126 axially toward non-orbiting scroll 70 during both the first and second modes. When modulation control valve assembly 132 is operated in the first mode, modulation valve ring 126 may be in the first position (FIG. 2). In the first mode, suction pressure ($P_s$) within modulation control chamber 174 may provide a second axial force ($F_2$) opposite first axial force ($F_1$) urging modulation valve ring 126 axially away from non-orbiting scroll 70. First axial force ($F_1$) may be greater than second axial force ($F_2$). Therefore, modulation valve ring 126 may be in the first position during operation of modulation control valve assembly 132 in the first mode. The first position may include valve portion 142 of modulation valve ring 126 abutting end plate 84 and closing first and second modulation ports 112, 114.

When modulation control valve assembly 132 is operated in the second mode, modulation valve ring 126 may be in the second position (FIG. 3). In the second mode, first intermediate pressure ($P_{i1}$) within modulation control chamber 174 may provide a third axial force ($F_3$) acting on modulation valve ring 126 and opposite first axial force ($F_1$) urging modulation valve ring 126 axially away from non-orbiting scroll 70. Since modulation control chamber 174 and axial biasing chamber 180 are in fluid communication with one another during operation of the modulation control valve assembly 132 in the second mode, both may operate at approximately the same first intermediate pressure ($P_{i1}$). Third axial force ($F_3$) may be greater than first axial force ($F_1$) since second radial surface area ($A_2$) is greater than first radial surface area ($A_1$). Therefore, modulation valve ring 126 may be in the second position during operation of modulation control valve assembly 132 in the second mode. The second position may include valve portion 142 of modulation valve ring 126 being displaced from end plate 84 and opening first and second modulation ports 112, 114. Modulation valve ring 126 may abut retaining ring 130 when in the second position.

Modulation valve ring 126 and modulation lift ring 128 may be forced in axial directions opposite one another during operation of modulation control valve assembly 132 in the second mode. More specifically, modulation valve ring 126 may be displaced axially away from end plate 84 and modulation lift ring 128 may be urged axially toward end plate 84. Protrusions 177 of modulation lift ring 128 may abut end plate 84 and first and second modulation ports 112, 114 may be in fluid communication with suction pressure region 106 via radial flow passages 178 when modulation valve ring 126 is in the second position.

Figure 5:
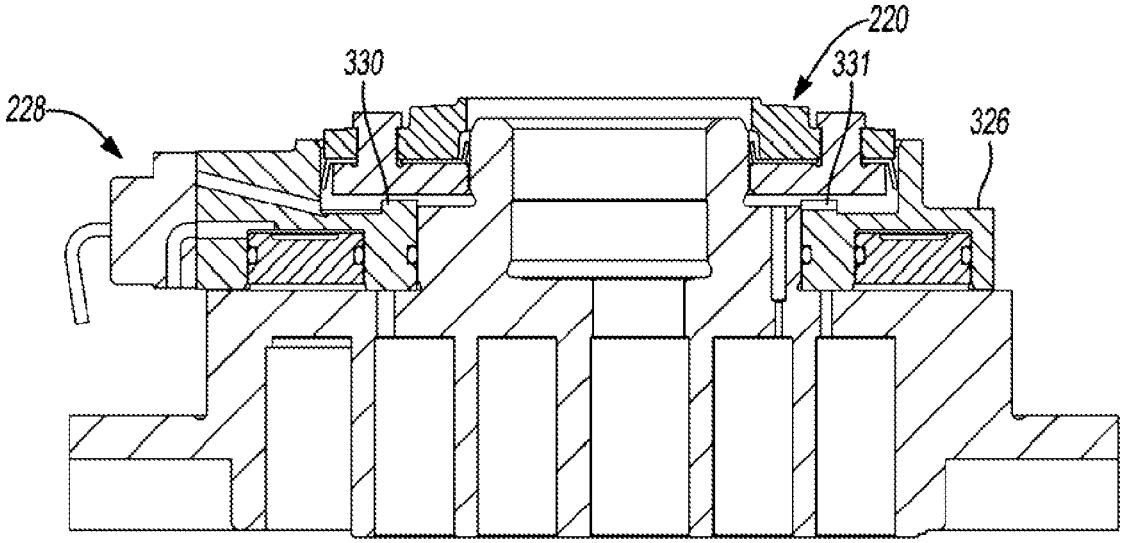
FIG. 5 is a section view of an alternate non-orbiting scroll member and capacity modulation assembly according to the present disclosure in a first operating mode.
Figure 6:
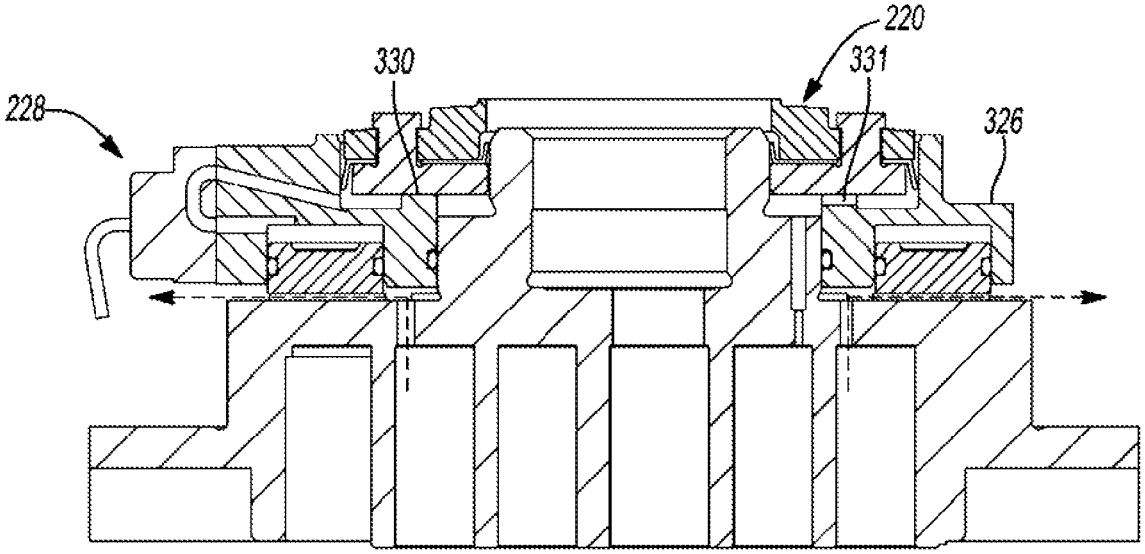
FIG. 6 is a section view of the non-orbiting scroll member and capacity modulation assembly of FIG. 5 in a second operating mode.

An alternate capacity modulation assembly 228 is illustrated in FIGS. 5 and 6. Capacity modulation assembly 228 may be generally similar to capacity modulation assembly 28 and may be incorporated into compressor 10 as discussed below. Therefore, it is understood that the description of capacity modulation assembly 28 applies equally to capacity modulation assembly 228 with the exceptions noted below. Modulation valve ring 326 may include axially extending protrusions 330 in place of retaining ring 130 of capacity modulation assembly 28. Protrusions 330 may be circumferentially spaced from one another, forming flow paths 331 therebetween. When modulation valve ring 326 is displaced from the first position (FIG. 5) to the second position (FIG. 6), protrusions 330 may abut seal assembly 220 to provide an axial stop for modulation valve ring 326.

Figure 28:
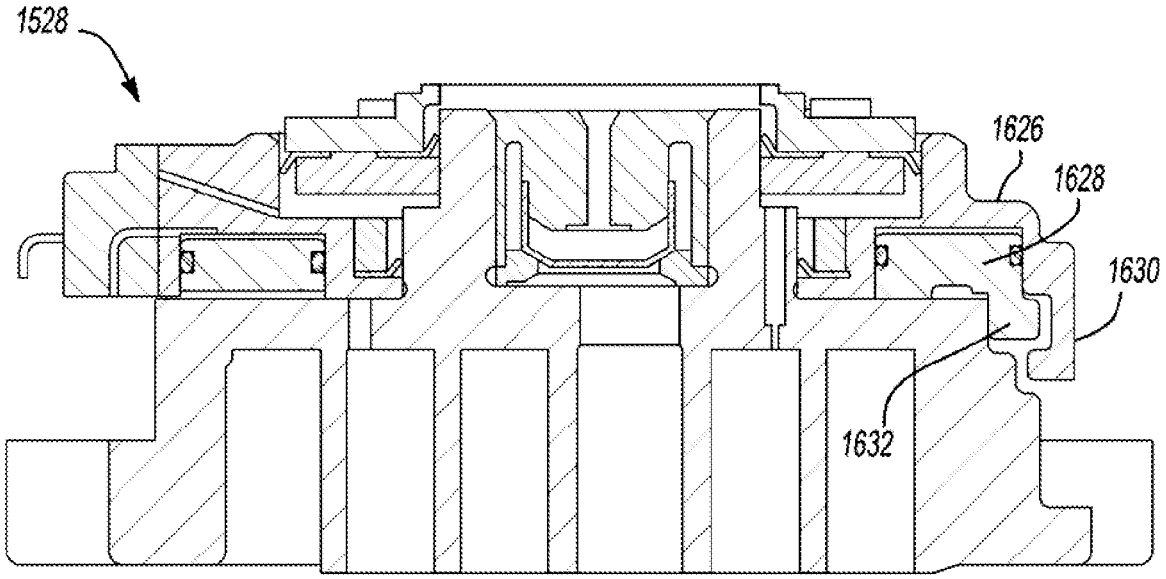
FIG. 28 is a section view of an alternate non-orbiting scroll member and capacity modulation assembly according to the present disclosure in a first operating mode.
Figure 29:
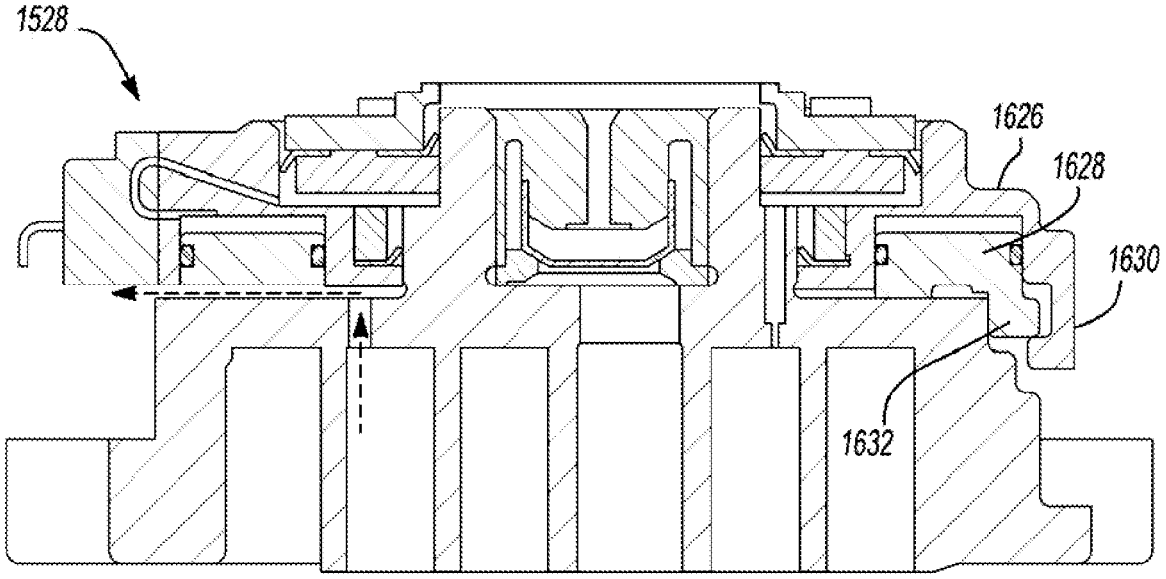
FIG. 29 is a section view of the non-orbiting scroll member and capacity modulation assembly of FIG. 28 in a second operating mode.

An alternate capacity modulation assembly 1528 is illustrated in FIGS. 28 and 29. Capacity modulation assembly 1528 may be generally similar to capacity modulation assembly 28 and may be incorporated into compressor 10 as discussed below. Therefore, it is understood that the description of capacity modulation assembly 28 applies equally to capacity modulation assembly 1528 with the exceptions noted below. Modulation valve ring 1626 may include axially extending protrusions 1630 and modulation lift ring 1628 may include axially extending protrusions 1632. Protrusions 1630 may extend axially beyond and radially inward relative to protrusions 1632. When modulation valve ring 1626 is displaced from the first position (FIG. 28) to the second position (FIG. 29), protrusions 1630 may abut protrusions 1632 to provide an axial stop for modulation valve ring 1626.

Figure 7:
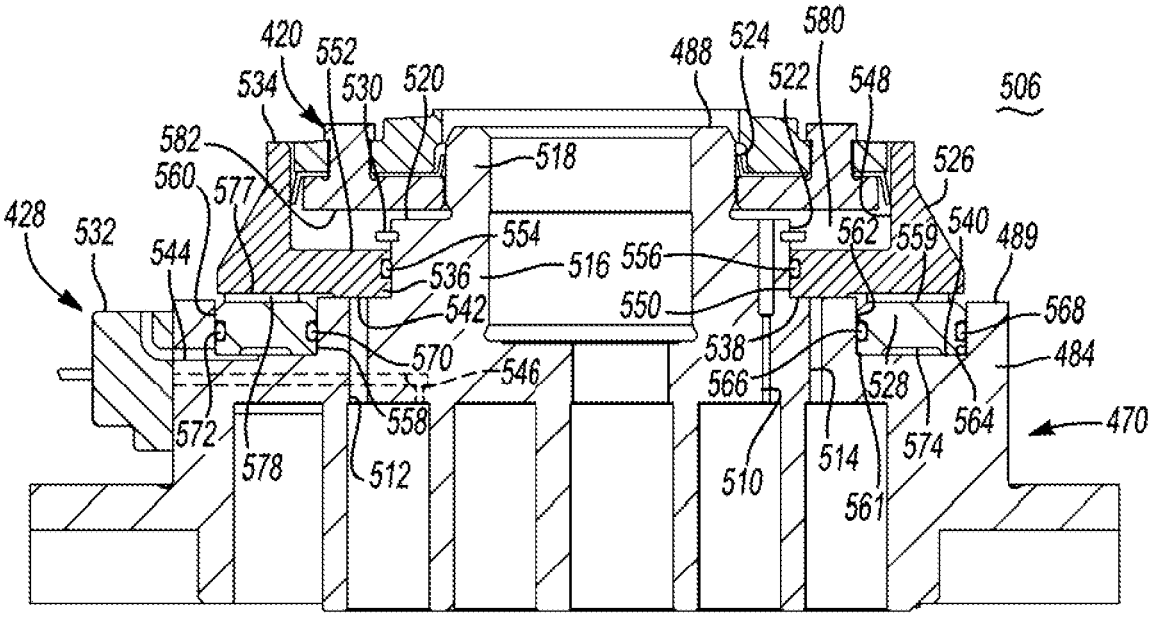
FIG. 7 is a section view of an alternate non-orbiting scroll member and capacity modulation assembly according to the present disclosure in a first operating mode.
Figure 8:
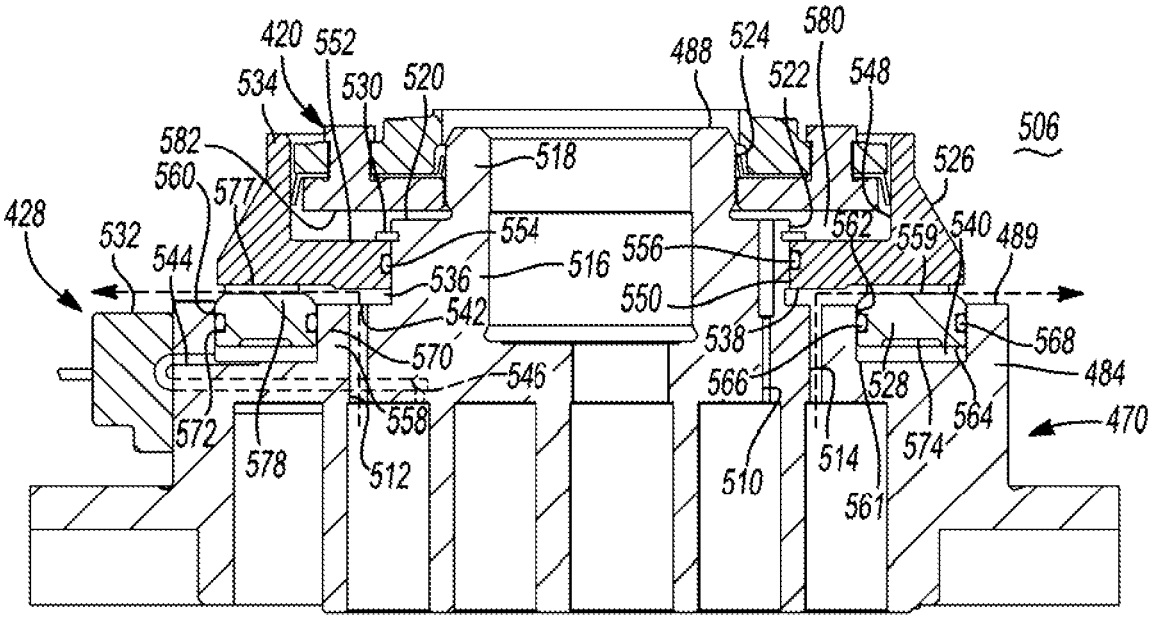
FIG. 8 is a section view of the non-orbiting scroll member and capacity modulation assembly of FIG. 7 in a second operating mode.

An alternate non-orbiting scroll 470 and capacity modulation assembly 428 are illustrated in FIGS. 7 and 8. End plate 484 of non-orbiting scroll 470 may include a biasing passage 510, first and second modulation ports 512, 514, an annular recess 540, and first and second passages 544, 546. Biasing passage 510, first and second modulation ports 512, 514, and second passage 546 may each be in fluid communication with one of the intermediate compression pockets. Biasing passage 510 may be in fluid communication with one of the intermediate compression pockets operating at a higher pressure than ones of intermediate compression pockets in fluid communication with first and second modulation ports 512, 514. In the arrangement shown in FIGS. 7 and 8, second passage 546 may be in communication with one of the intermediate compression pockets operating at a higher pressure than or equal to the intermediate compression pocket in communication with biasing passage 510.

Annular hub 488 may include first and second portions 516, 518 axially spaced from one another forming a stepped region 520 therebetween. First portion 516 may be located axially between second portion 518 and end plate 484 and may have an outer radial surface 522 defining a diameter ($D_7$) greater than or equal to a diameter ($D_8$) defined by an outer radial surface 524 of second portion 518.

Capacity modulation assembly 428 may include a modulation valve ring 526, a modulation lift ring 528, a retaining ring 530, and a modulation control valve assembly 532. Modulation valve ring 526 may include an axial leg 534 and a radial leg 536. Radial leg 536 may include a first axial end surface 538 facing end plate 484 and defining a valve portion 542 and a second axial end surface 552 facing seal assembly 420. An inner radial surface 548 of axial leg 534 may define a diameter ($D_9$) greater than a diameter ($D_{10}$) defined by an inner radial surface 550 of radial leg 536. The diameters ($D_7$, $D_{10}$) may be approximately equal to one another and first portion 516 of annular hub 488 may be sealingly engaged with radial leg 536 of modulation valve ring 526 via a seal 554 located radially therebetween. More specifically, seal 554 may include an o-ring seal and may be located within an annular recess 556 in inner radial surface 550 of modulation valve ring 526.

Modulation lift ring 528 may be located within annular recess 540 and may include an annular body defining inner and outer radial surfaces 558, 560, and first and second axial end surfaces 559, 561. Annular recess 540 may extend axially into second side 489 of end plate 484. Inner and outer radial surfaces 558, 560 may be sealingly engaged with sidewalls 562, 564 of annular recess 540 via first and second seals 566, 568. More specifically, first and second seals 566, 568 may include o-ring seals and may be located within annular recesses 570, 572 in inner and outer radial surfaces 558, 560 of modulation lift ring 528. End plate 484 and modulation lift ring 528 may cooperate to define a modulation control chamber 574 between annular recess 540 and second axial end surface 561. First passage 544 may be in fluid communication with modulation control chamber 574. First axial end surface 559 may face modulation valve ring 526 and may include a series of protrusions 577 defining radial flow passages 578 therebetween.

Seal assembly 420 may form a floating seal assembly and may be sealingly engaged with non-orbiting scroll 470 and modulation valve ring 526 to define an axial biasing chamber 580. More specifically, seal assembly 420 may be sealingly engaged with outer radial surface 524 of annular hub 488 and inner radial surface 548 of modulation valve ring 526. Axial biasing chamber 580 may be defined axially between an axial end surface 582 of seal assembly 420 and second axial end surface 552 of modulation valve ring 526 and by stepped region 520 of annular hub 488.

Retaining ring 530 may be axially fixed relative to non-orbiting scroll 470 and may be located within axial biasing chamber 580. More specifically, retaining ring 530 may be located within a recess in first portion 516 of annular hub 488 axially between seal assembly 420 and modulation valve ring 526. Retaining ring 530 may form an axial stop for modulation valve ring 526. Modulation control valve assembly 532 may include a solenoid operated valve and may be in fluid communication with first and second passages 544, 546 in end plate 484 and suction pressure region 506.

Figure 20:
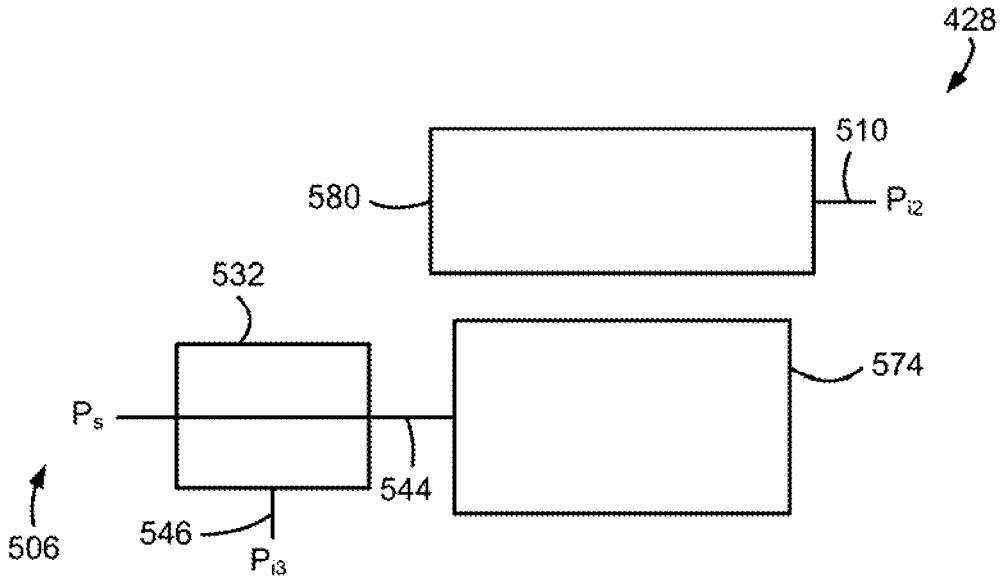
FIG. 20 is a schematic illustration of the capacity modulation assembly of FIG. 7 in the first operating mode.
Figure 21:
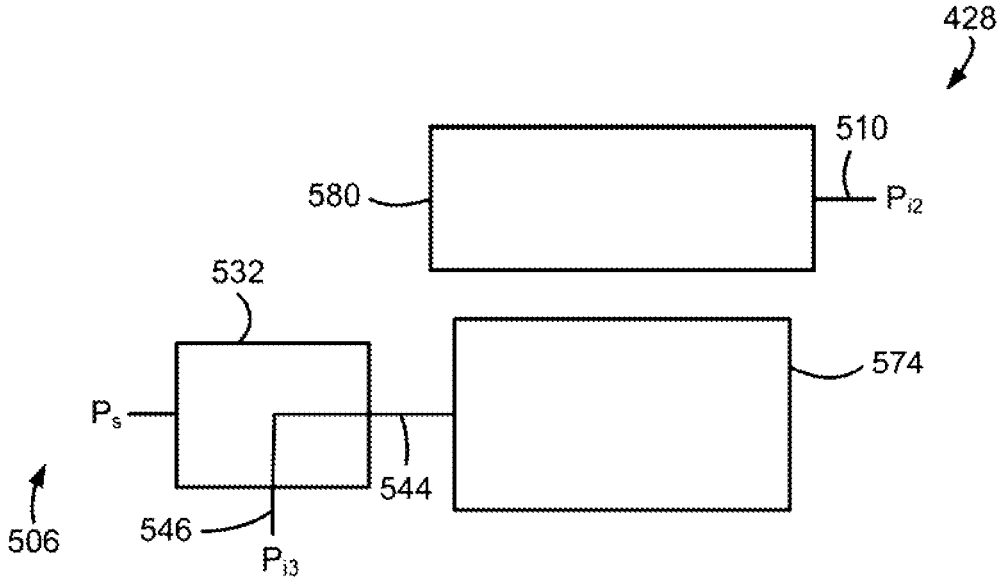
FIG. 21 is a schematic illustration of the capacity modulation assembly of FIG. 8 in the second operating mode.

With additional reference to FIGS. 20 and 21, during compressor operation, modulation control valve assembly 532 may be operated in first and second modes. FIGS. 20 and 21 schematically illustrate operation of modulation control valve assembly 532. In the first mode, seen in FIGS. 7 and 20, modulation control valve assembly 532 may provide fluid communication between modulation control chamber 574 and suction pressure region 506. More specifically, modulation control valve assembly 532 may provide fluid communication between first passage 544 and suction pressure region 506 during operation in the first mode. In the second mode, seen in FIGS. 8 and 21, modulation control valve assembly 532 may provide fluid communication between modulation control chamber 574 and second passage 546.

Figure 22:
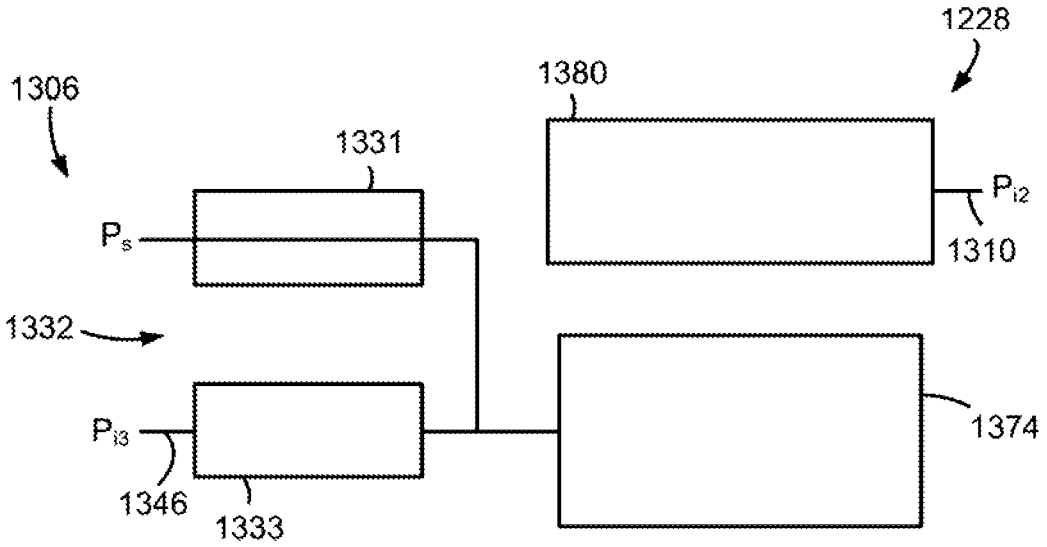
FIG. 22 is a schematic illustration of an alternate capacity modulation assembly in the first operating mode.
Figure 23:
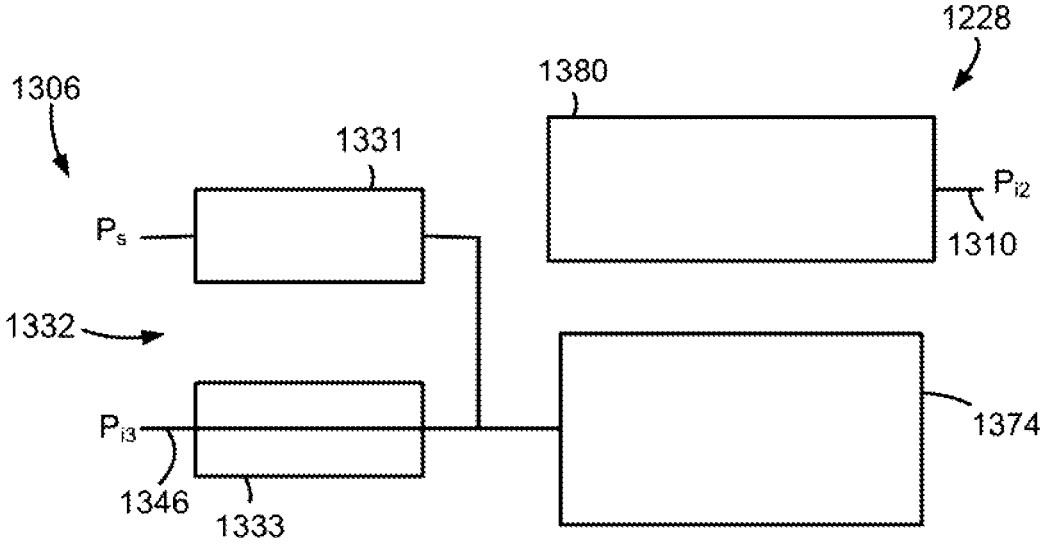
FIG. 23 is a schematic illustration of the alternate capacity modulation assembly of FIG. 22 in the second operating mode.

In an alternate capacity modulation assembly 1228, seen in FIGS. 22 and 23, a modulation control valve assembly 1332 may include first and second modulation control valves 1331, 1333. Capacity modulation assembly 1228 may be incorporated into compressor 10 as discussed below. First modulation control valve 1331 may be in communication with suction pressure region 1306, modulation control chamber 1374 and second modulation control valve 1333. Second modulation control valve 1333 may be in communication with second passage 1346 (similar to second passage 546), modulation control chamber 1374 and first modulation control valve 1331. Modulation control valve assembly 1332 may be operated in first and second modes. Similar to the capacity modulation assembly 428, biasing chamber 1380 and first passage 1310 (similar to biasing passage 510) may be isolated from communication with modulation control valve assembly 1332 and modulation control chamber 1374 during both the first and second modes.

In the first mode, seen in FIG. 22, first modulation control valve 1331 may be open, providing communication between modulation control chamber 1374 and suction pressure region 1306, and second modulation control valve 1333 may be closed, isolating modulation control chamber 1374 from second passage 1346. In the second mode, seen in FIG. 23, first modulation control valve 1331 may be closed, isolating modulation control chamber 1374 from suction pressure region 1306, and second modulation control valve 1333 may be open, providing communication between modulation control chamber 1374 and second passage 1346.

Figure 24:
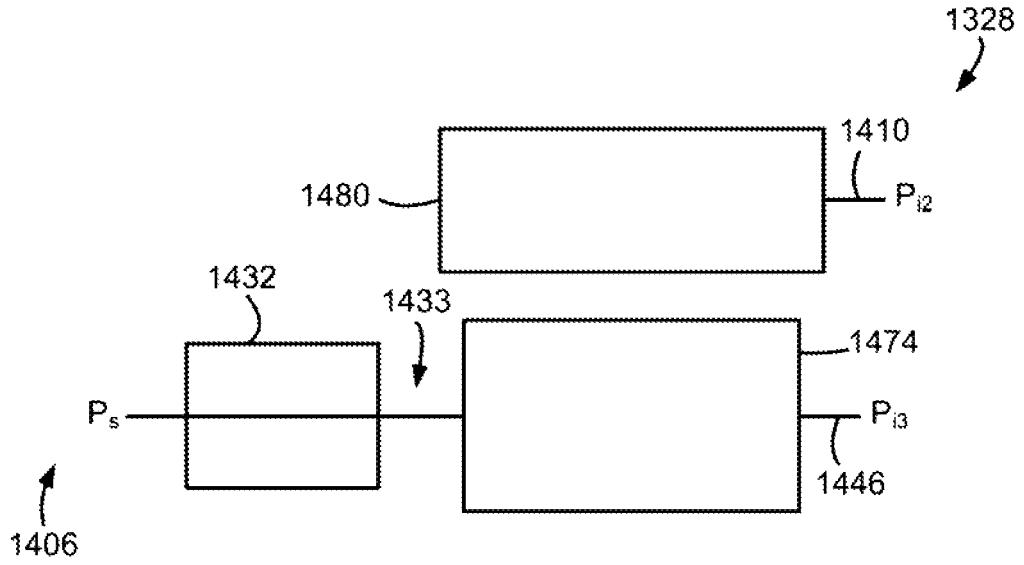
FIG. 24 is a schematic illustration of an alternate capacity modulation assembly in the first operating mode.
Figure 25:
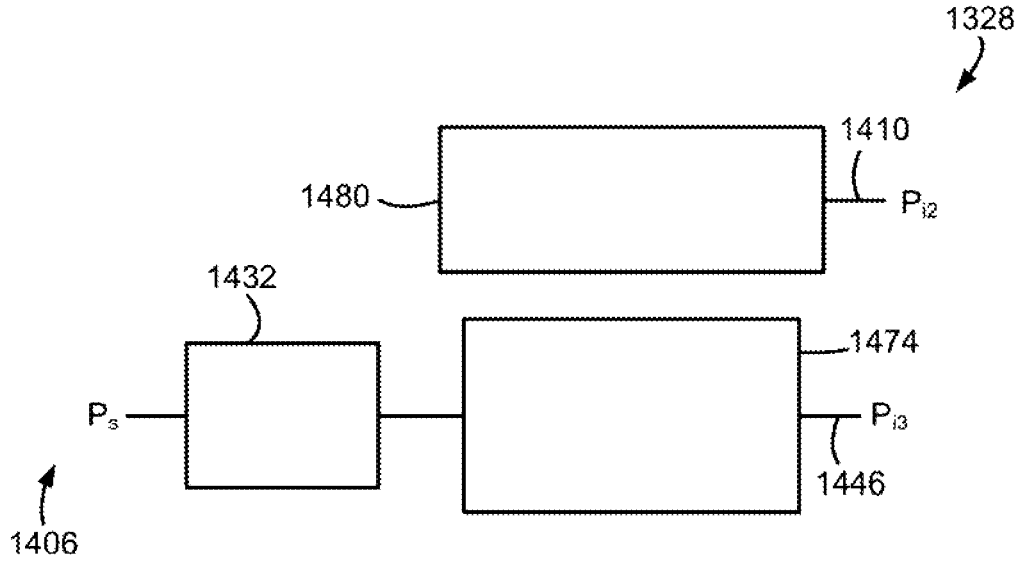
FIG. 25 is a schematic illustration of the alternate capacity modulation assembly of FIG. 24 in the second operating mode.

An alternate capacity modulation assembly 1328 is shown in FIGS. 24 and 25. Capacity modulation assembly 1328 may be incorporated into compressor 10 as discussed below. In the arrangement of FIGS. 24 and 25, modulation control chamber 1474 may be in communication with second passage 1446 (similar to second passage 546) and modulation control valve assembly 1432. Modulation control valve assembly 1432 may be in communication with modulation control chamber 1474 and suction pressure region 1406. Modulation control valve assembly 1432 may be operated in first and second modes. Similar to capacity modulation assembly 428, biasing chamber 1480 and first passage 1410 (similar to biasing passage 510) may be isolated from communication with modulation control valve assembly 1432 and modulation control chamber 1474 during both the first and second modes.

In the first mode, seen in FIG. 24, modulation control valve assembly 1432 may be open, providing communication between modulation control chamber 1474 and suction pressure region 1406 via a third passage 1433. Second passage 1446 may define a greater flow restriction than third passage 1433. In the second mode, seen in FIG. 25, modulation control valve assembly 1432 may be closed, isolating modulation control chamber 1474 from communication with suction pressure region 1406.

Figure 26:
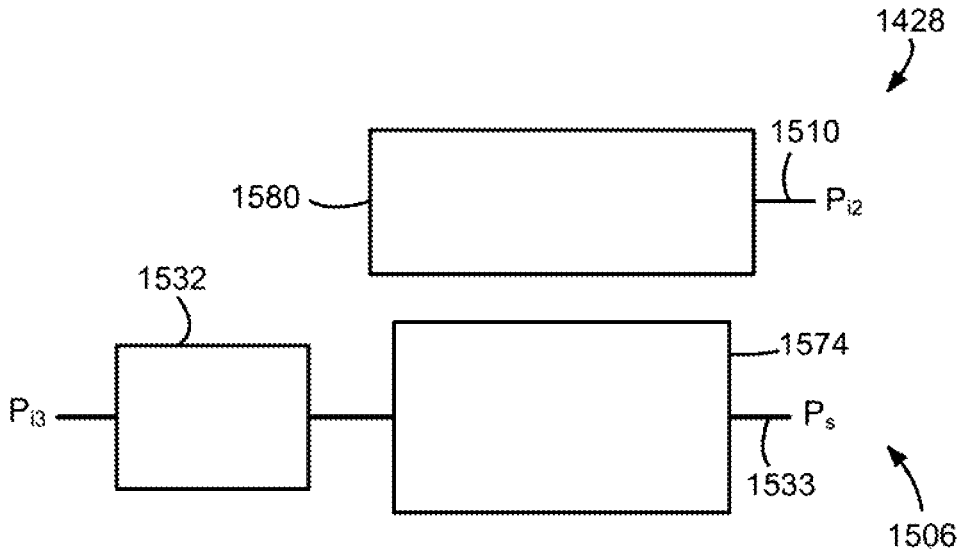
FIG. 26 is a schematic illustration of an alternate capacity modulation assembly in the first operating mode.
Figure 27:
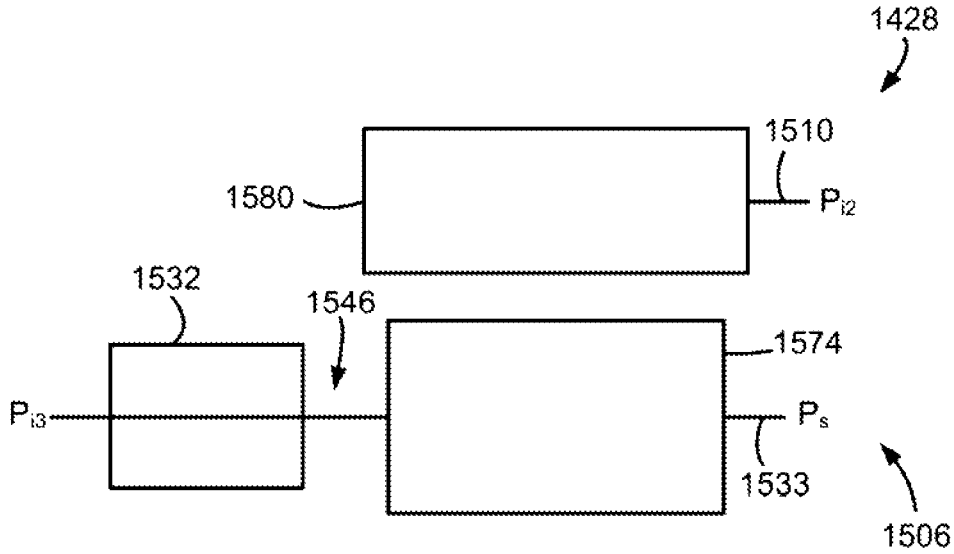
FIG. 27 is a schematic illustration of the alternate capacity modulation assembly of FIG. 26 in the second operating mode.

Another capacity modulation assembly 1428 is shown in FIGS. 26 and 27. Capacity modulation assembly 1428 may be incorporated into compressor 10 as discussed below. In the arrangement of FIGS. 26 and 27, modulation control chamber 1574 may be in communication with suction pressure region 1506 via a third passage 1533. Modulation control valve assembly 1532 may be in communication with modulation control chamber 1574 and second passage 1546 (similar to second passage 546). Modulation control valve assembly 1532 may be operated in first and second modes. Similar to capacity modulation assembly 428, biasing chamber 1580 and first passage 1510 (similar to biasing passage 510) may be isolated form communication with modulation control valve assembly 1532 and modulation control chamber 1574 during both the first and second modes.

In the first mode, seen in FIG. 26, modulation control valve assembly 1532 may be closed, isolating modulation control chamber 1574 from communication with a biasing pressure. In the second mode, seen in FIG. 27, modulation control valve assembly 1532 may be open, providing communication between modulation control chamber 1574 and a biasing pressure via second passage 1546. Third passage 1533 may provide a greater flow restriction than second passage 1546.

Modulation valve ring 526 may define a first radial surface area ($A_{11}$) facing away from non-orbiting scroll 470 radially between inner radial surfaces 548, 550 of modulation valve ring 526 ($A_{11}=(\pi)(D_9^2-D_{10}^2)/4$). Sidewalls 562, 564 may define inner and outer diameters ($D_{11}$, $D_{12}$). Modulation lift ring 528 may define a second radial surface area ($A_{22}$) opposite first radial surface area ($A_{11}$) and facing non-orbiting scroll 70 radially between sidewalls 562, 564 of end plate 484 ($A_{22}=(\pi)(D_{12}^2-D_{11}^2)/4$). First radial surface area ($A_{11}$) may be greater than second radial surface area ($A_{22}$). Modulation valve ring 526 may be displaced between first and second positions based on the pressure provided to modulation control chamber 574 by modulation control valve assembly 532. Modulation lift ring 528 may displace modulation valve ring 526, as discussed below. The arrangement shown in FIGS. 7 and 8 generally provides for a narrower non-orbiting scroll 470 and capacity modulation assembly 428 arrangements. However, it is understood that alternate arrangements may exist where the second radial surface area ($A_{22}$) is greater than the first radial surface area ($A_{11}$), as in FIGS. 2 and 3.

A second intermediate pressure ($P_{i2}$) within axial biasing chamber 580 applied to first radial surface area ($A_{11}$) may provide a first axial force ($F_{11}$) urging modulation valve ring 526 axially toward non-orbiting scroll 470 during both the first and second modes. When modulation control valve assembly 532 is operated in the first mode, modulation valve ring 526 may be in the first position (FIG. 7). In the first mode, suction pressure ($P_s$) within modulation control chamber 574 may provide a second axial force ($F_{22}$) opposite first axial force ($F_{11}$). Modulation lift ring 528 may apply second axial force ($F_{22}$) to modulation valve ring 526 to bias modulation valve ring 526 axially away from non-orbiting scroll 470. First axial force ($F_{11}$) may be greater than second axial force ($F_{22}$). Therefore, modulation valve ring 526 may be in the first position during operation of modulation control valve assembly 532 in the first mode. The first position may include valve portion 542 of modulation valve ring 526 abutting end plate 484 and closing first and second modulation ports 512, 514.

When modulation control valve assembly 532 is operated in the second mode, modulation valve ring 526 may be in the second position (FIG. 8). In the second mode, a third intermediate pressure ($P_{i3}$) from the intermediate compression pocket in fluid communication with second passage 546 may provide a third axial force ($F_{33}$) opposite first axial force ($F_{11}$) urging modulation lift ring 528 axially toward modulation valve ring 526. Modulation lift ring 528 may apply third axial force ($F_{33}$) to modulation valve ring 526 to bias modulation valve ring 526 axially away from non-orbiting scroll 470. Third axial force ($F_{33}$) may be greater than first axial force ($F_{11}$) even when second radial surface area ($A_{22}$) is less than first radial surface area ($A_{11}$) since modulation control chamber 574 operates at a higher pressure than axial biasing chamber 580 during the second mode ($P_{i3}>P_{i2}$). Modulation control chamber 574 may operate at the same pressure as axial biasing chamber 580 and therefore $A_{22}$ may be greater than $A_{11}$. Therefore, modulation valve ring 526 may be in the second position during operation of modulation control valve assembly 532 in the second mode. The second position may include valve portion 542 of modulation valve ring 526 being displaced from end plate 484 and opening first and second modulation ports 512, 514. Modulation valve ring 526 may abut retaining ring 530 when in the second position.

Modulation valve ring 526 and modulation lift ring 528 may be forced in the same axial direction during operation of modulation control valve assembly 532 in the second mode. More specifically, modulation valve ring 526 and modulation lift ring 528 may both be displaced axially away from end plate 484. Protrusions 577 of modulation lift ring 528 may abut modulation valve ring 526 and first and second modulation ports 512, 514 may be in fluid communication with suction pressure region 506 via radial flow passages 578 when modulation valve ring 526 is in the second position.

Figure 9:
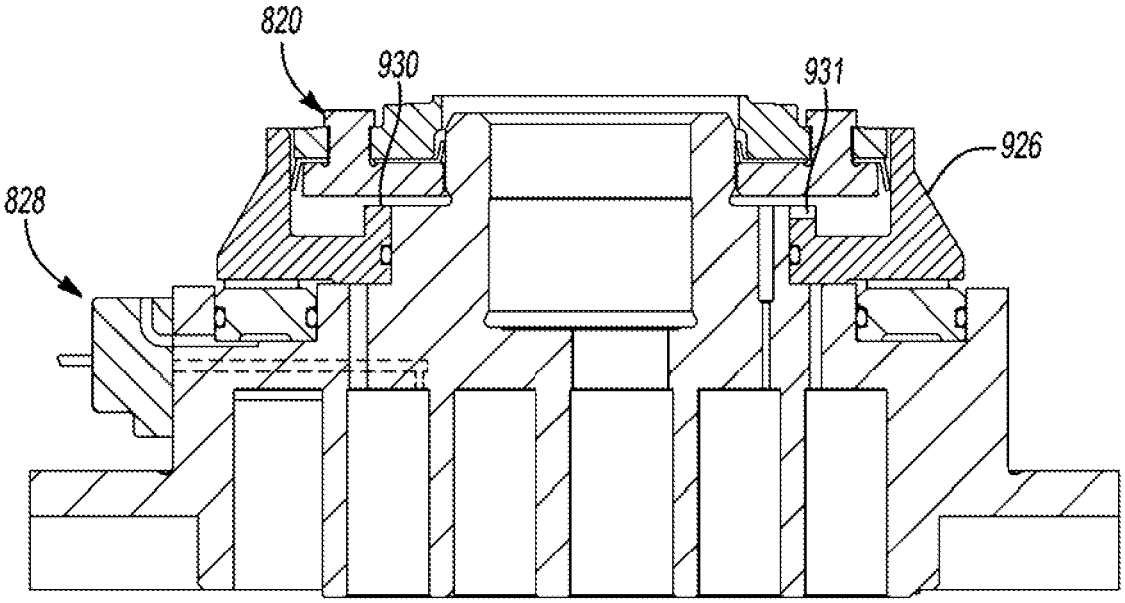
FIG. 9 is a section view of an alternate non-orbiting scroll member and capacity modulation assembly according to the present disclosure in a first operating mode.
Figure 10:
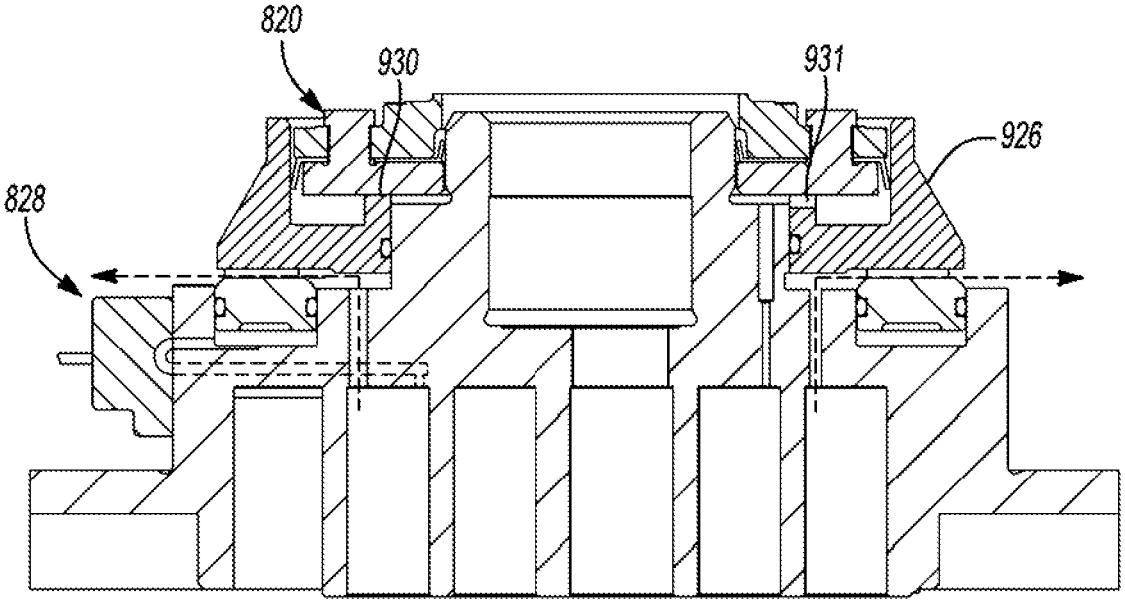
FIG. 10 is a section view of the non-orbiting scroll member and capacity modulation assembly of FIG. 9 in a second operating mode.

An alternate capacity modulation assembly 828 is illustrated in FIGS. 9 and 10. Capacity modulation assembly 828 may be generally similar to capacity modulation assembly 428. Therefore, it is understood that the description of capacity modulation assembly 428 applies equally to capacity modulation assembly 828 with the exceptions noted below. Modulation valve ring 926 may include axially extending protrusions 930 in place of retaining ring 530 of capacity modulation assembly 428. Protrusions 930 may be circumferentially spaced from one another, forming flow paths 931 therebetween. When modulation valve ring 926 is displaced from the first position (FIG. 9) to the second position (FIG. 10), protrusions 930 may abut seal assembly 820 to provide an axial stop for modulation valve ring 926.

Figure 11:
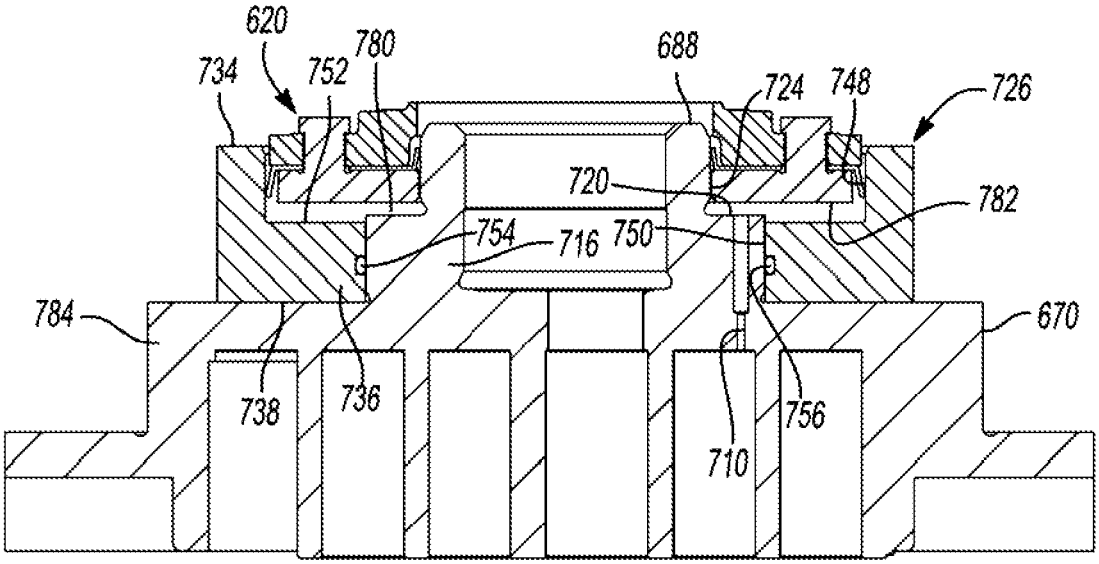
FIG. 11 is a section view of an alternate non-orbiting scroll member according to the present disclosure.

In an alternate arrangement, seen in FIG. 11, non-orbiting scroll 670 may be used in compressor 10 in place of non-orbiting scroll 70 and capacity modulation assembly 28. Non-orbiting scroll 670 may be similar to non-orbiting scroll 70, with the exception of first and second modulation ports 112, 114. Instead of capacity modulation assembly 28, non-orbiting scroll 670 may have an outer hub 726 engaged therewith. More specifically, outer hub 726 may include an axial leg 734 and a radial leg 736.

Radial leg 736 may include a first axial end surface 738 facing end plate 784 and a second axial end surface 752 facing seal assembly 620. First portion 716 of annular hub 688 may be sealingly engaged with radial leg 736 of outer hub 726 via a seal 754 located radially therebetween. More specifically, seal 754 may include an o-ring seal and may be located within an annular recess 756 in inner radial surface 750 of outer hub 726.

Seal assembly 620 may form a floating seal assembly and may be sealingly engaged with non-orbiting scroll 670 and outer hub 726 to define an axial biasing chamber 780. More specifically, seal assembly 620 may be sealingly engaged with outer radial surface 724 of annular hub 688 and inner radial surface 748 of axial leg 734. Axial biasing chamber 780 may be defined axially between an axial end surface 782 of seal assembly 620 and second axial end surface 752 of outer hub 726 and stepped portion 720 of annular hub 688. Biasing passage 710 may extend through stepped region 720 of annular hub 688 to provide fluid communication between axial biasing chamber 780 and an intermediate compression pocket.

Outer hub 726 may be press fit on non-orbiting scroll 670 and fixed thereto without the use of fasteners by the press-fit engagement, as well as by pressure within axial biasing chamber 780 acting on second axial end surface 752 during compressor operation. Therefore, a generally common non-orbiting scroll 70, 270, 470, 670 may be used for a variety of applications including compressors with and without capacity modulation assemblies or first and second modulation ports 112, 512, 114, 514 of non-orbiting scrolls 70, 270, 470.

What is claimed is:

1. A compressor comprising:

a shell assembly defining a suction-pressure region and a discharge-pressure region, said shell assembly including a partition separating said suction-pressure region from said discharge-pressure region;

a first scroll member disposed within said shell assembly and including a first end plate having a discharge passage, a modulation port, a biasing passage, and a first spiral wrap extending from said first end plate;

a second scroll member disposed within said shell assembly and including a second end plate having a second spiral wrap extending therefrom, said first and second spiral wraps meshingly engaged and forming a series of pockets during orbital displacement of said second scroll member relative to said first scroll member, said modulation port in communication with a first one of said pockets, said biasing passage in communication with a second one of said pockets;

a floating seal assembly engaged with said partition and said first scroll member and isolating said discharge-pressure region from said suction-pressure region; and a modulation valve ring located axially between said floating seal assembly and said first end plate and being in sealing engagement with an outer radial surface of a hub extending from said first end plate and an outer radial surface of said floating seal assembly to define an axial biasing chamber in fluid communication with said biasing passage, said modulation valve ring being axially displaceable between first and second positions, said modulation valve ring abutting said first end plate and closing said modulation port when in said first position, said modulation valve ring abutting an axially facing surface of said floating seal assembly and spaced apart from said first end plate to open said modulation port when in said second position.

2. The compressor of claim 1, wherein said modulation valve ring urges said floating seal assembly axially against said partition when said modulation valve ring is in said second position.

3. The compressor of claim 2, further comprising a modulation lift ring located axially between said modulation valve ring and said first end plate and in sealing engagement with said modulation valve ring to define a modulation control chamber between said modulation valve ring and said modulation lift ring.

4. The compressor of claim 3, further comprising a modulation control valve assembly operable in first and second modes and in fluid communication with said modulation control chamber, said modulation control valve assembly controlling an operating pressure within said modulation control chamber and providing a first pressure within said modulation control chamber when operated in the first mode to displace said modulation valve ring to the first position and operate the compressor in a full capacity mode and providing a second pressure within said modulation control chamber greater than the first pressure when operated in the second mode to displace said modulation valve ring to the second position and operate the compressor in a partial capacity mode.

5. The compressor of claim 4, wherein a radially extending passage is formed axially between said modulation valve ring and said first end plate when said modulation valve ring is in said second position, and wherein said radially extending passage is in communication with said modulation port.

6. The compressor of claim 5, wherein said radially extending passage extends between said modulation lift ring and said first end plate.

7. The compressor of claim 4, wherein the first pressure is a suction pressure within the compressor and the second pressure is an operating pressure within said biasing chamber.

8. The compressor of claim 7, wherein the modulation control valve assembly includes a first valve in communication with said modulation control chamber and said biasing chamber and operable in an open and a closed position for selective communication between said modulation control chamber and said biasing chamber and a second valve in communication with said modulation control chamber and said suction pressure region and operable in an open and a closed position for selective communication between said modulation control chamber and said suction pressure region.

9. The compressor of claim 8, wherein the compressor is operating in the full capacity mode when said first valve is closed and said second valve is open.

10. The compressor of claim 8, wherein the compressor is operating in the partial capacity mode when said first valve is open and said second valve is closed.

11. The compressor of claim 8, wherein the compressor is operating in an unloaded mode when said first and second valves are open.

12. The compressor of claim 8, wherein the compressor is operating in a first pulse-width-modulated-capacity mode or a second-pulse-width-modulated-capacity mode when one of said first and second valves are pulse width modulated.

13. The compressor of claim 1, wherein the compressor is operable in an unloaded mode to operate the compressor at approximately zero capacity during orbital displacement of said second scroll member relative to said first scroll member.

14. The compressor of claim 1, wherein said modulation valve ring includes axially extending protrusions that contact the floating seal assembly when said modulation valve ring is in said second position.

15. A compressor comprising:

a first scroll member including a first end plate having a discharge passage, a modulation port, a biasing passage, and a first spiral wrap extending from said first end plate;

a second scroll member including a second end plate having a second spiral wrap extending therefrom, said first and second spiral wraps meshingly engaged and forming a series of pockets during orbital displacement of said second scroll member relative to said first scroll member, said modulation port in communication with a first one of said pockets, said biasing passage in communication with a second one of said pockets;

a seal assembly engaged with said first scroll member and isolating a discharge-pressure region of the compressor from a suction-pressure region of the compressor; and a valve ring located axially between said seal assembly and said first end plate and being received on a hub extending from said first end plate and receiving said seal assembly to define an axial biasing chamber in fluid communication with said biasing passage, said valve ring being displaceable between first and second positions, said valve ring abutting said first end plate and closing said modulation port when in said first position, said valve ring being spaced apart from said first end plate to open said modulation port when in said second position, said seal assembly defining a stop limiting range of motion of said valve ring between said first and second positions.

16. The compressor of claim 15, wherein said valve ring urges said seal assembly axially against a partition when said valve ring is in said second position, said partition separating said discharge-pressure region from said suction-pressure region.

17. The compressor of claim 16, further comprising a lift ring located axially between said valve ring and said first end plate and in sealing engagement with said valve ring to define a control chamber between said valve ring and said lift ring.

18. The compressor of claim 17, wherein a radially extending passage is formed axially between said valve ring and said first end plate when said valve ring is in said second position, and wherein said radially extending passage is in communication with said modulation port, and wherein said radially extending passage extends between said lift ring and said first end plate.

19. The compressor of claim 17, further comprising a control valve assembly operable in first and second modes and in fluid communication with said control chamber, said control valve assembly controlling an operating pressure within said control chamber and providing a first pressure within said control chamber when operated in the first mode to displace said valve ring to the first position and operate the compressor in a full capacity mode and providing a second pressure within said control chamber greater than the first pressure when operated in the second mode to displace said valve ring to the second position and operate the compressor in a partial capacity mode.

20. The compressor of claim 19, wherein the control valve assembly includes a first valve in communication with said control chamber and said biasing chamber and operable in an open and a closed position for selective communication between said control chamber and said biasing chamber and a second valve in communication with said control chamber and said suction-pressure region and operable in an open and a closed position for selective communication between said control chamber and said suction-pressure region.

21. The compressor of claim 15, wherein said valve ring abuts an axially facing surface of said seal assembly when in said second position.

* * * * *